US008452221B2

(12) United States Patent
Kaneko et al.

(10) Patent No.: US 8,452,221 B2
(45) Date of Patent: May 28, 2013

(54) FIXATION FLUID, FIXATION METHOD, IMAGE FORMING METHOD, FIXATION DEVICE, AND IMAGE FORMING APPARATUS

(75) Inventors: Fuminari Kaneko, Tokyo (JP); Yasuo Katano, Kanagawa (JP); Tsuneo Kurotori, Tokyo (JP); Yukimichi Someya, Saitama (JP); Yuko Arizumi, Kanagawa (JP); Shigeo Takeuchi, Kanagawa (JP); Takahiko Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 253 days.

(21) Appl. No.: 13/124,730

(22) PCT Filed: Oct. 7, 2009

(86) PCT No.: PCT/JP2009/067824

§ 371 (c)(1),
(2), (4) Date: Apr. 18, 2011

(87) PCT Pub. No.: WO2010/058668

PCT Pub. Date: May 27, 2010

(65) Prior Publication Data

US 2011/0229231 A1 Sep. 22, 2011

(30) Foreign Application Priority Data

Nov. 18, 2008 (JP) ..... 2008-294824
Apr. 15, 2009 (JP) ..... 2009-099250

(51) Int. Cl.
*G03G 15/20* (2006.01)

(52) U.S. Cl.
USPC ..... 399/340

(58) Field of Classification Search
USPC ..... 399/340, 341; 430/104, 124.1
See application file for complete search history.

(56) References Cited

U.S. PATENT DOCUMENTS

| | | | |
|---|---|---|---|
| 5,476,739 | A | 12/1995 | Takama et al. |
| 5,666,628 | A | 9/1997 | Fukai |
| 2004/0131402 | A1 | 7/2004 | Kurotori et al. |
| 2007/0291066 | A1 | 12/2007 | Takabayashi et al. |

(Continued)

FOREIGN PATENT DOCUMENTS

| | | | |
|---|---|---|---|
| CN | 101266420 | A | 9/2008 |
| EP | 1 956 444 | A1 | 8/2008 |

(Continued)

OTHER PUBLICATIONS

Japanese Office Action issued Oct. 16, 2012 in Patent Application No. 2009-099250.

(Continued)

*Primary Examiner* — Hoang Ngo
(74) *Attorney, Agent, or Firm* — Oblon, Spivak, McClelland, Maier & Neustadt, L.L.P.

(57) ABSTRACT

Disclosed is a fixation fluid, including a softening agent(s), the softening agent(s) being a saturated aliphatic carboxylic acid ester(s) of a saturated aliphatic alcohol(s) and/or a carbonic acid ester(s) of a dihydric saturated aliphatic alcohol(s), a foaming agent(s), the foaming agent(s) being a non-ionic surfactant(s) and/or an amphoteric surfactant(s), water, a pH adjustor(s), the pH adjustor(s) being an acid(s) and/or a salt(s) of the acid(s), and a pH of the fixation fluid being 6 or more and 7 or less.

11 Claims, 7 Drawing Sheets

U.S. PATENT DOCUMENTS

| | | | | |
|---|---|---|---|---|
| 2008/0213002 | A1 | 9/2008 | Katano et al. | |
| 2009/0003903 | A1* | 1/2009 | Katano et al. | 399/340 |
| 2011/0217098 | A1* | 9/2011 | Tomono et al. | 399/340 |

FOREIGN PATENT DOCUMENTS

| | | | |
|---|---|---|---|
| JP | 59 119364 | | 7/1984 |
| JP | 7-72748 | A | 3/1995 |
| JP | 2002 52707 | | 2/2002 |
| JP | 3290513 | | 3/2002 |
| JP | 2004 109747 | | 4/2004 |
| JP | 2004 109749 | | 4/2004 |
| JP | 2005 335171 | | 12/2005 |
| JP | 2007 219105 | | 8/2007 |
| JP | 2007 331353 | | 12/2007 |

OTHER PUBLICATIONS

Chinese Office Action Issued Nov. 30, 2012 in Patent Application No. 200980145003.1 (with English translation).

International Search Report issued Nov. 17, 2009 in PCT/JP09/67824 filed Oct. 7, 2009.

* cited by examiner

FIXATION FLUID, FIXATION METHOD, IMAGE FORMING METHOD, FIXATION DEVICE, AND IMAGE FORMING APPARATUS

TECHNICAL FIELD

The present invention relates to at least one of a fixation fluid, a fixation method, an image forming method, a fixation device, and an image forming apparatus.

BACKGROUND ART

An image forming apparatus such as a printer, a facsimile machine, or a copying machine forms an image including a character or a symbol on a recording medium such as a paper sheet, a cloth or an OHP sheet based on image information, wherein it may be possible to form a high resolution image on a plane paper sheet at a high speed, and therefore, an electrophotography-type image forming apparatus has been used widely. Because the speed of fixation is high and the quality of a fixed image is high in such an electrophotography-type image forming apparatus, a thermal fixation method for fixing a toner on a recording medium by heating and melting the toner on the recording medium and pressurizing the melted toner has been used widely. However, about a half or more of an electrical power consumption is consumed for heating a toner in such an electrophotography-type image forming apparatus.

Meanwhile, a fixation device with a low electric power consumption (for energy-saving), that is, a non-heating fixation method for fixing a toner on a recording medium without heating it has been desired from the viewpoint of recent measures to address environmental issues.

Japanese Patent Application No. 2007-219105 discloses a method for fixing a resin fine particle on a medium by producing a fixation fluid in a foam-like shape, controlling a film thickness of the produced foam-like fixation fluid, and applying it on the resin fine particle on the medium. Then, the fixation fluid contains a softening agent for softening a resin fine particle containing a resin by dissolving or swelling at least a portion of the resin, a foaming agent, and a bubble-increasing agent. For the foaming agent, alkali soaps of higher fatty acid, such as sodium stearate, sodium palmitate, and sodium myristate are illustrated. Furthermore, for the bubble increasing agent, fatty acid akanol amide-type non-ionic surfactants such as coconut oil fatty acid diethanol amides, coconut oil fatty acid monoethanol amides, and lauric acid isopropanol amide are illustrated.

In a practical example of Japanese Patent Application No. 2007-219105, triethanolamine as a pH adjustor is used to reduce the alkalinity of a fixation fluid in order to improve the foaming property of a foaming agent, and if an aliphatic ester is used as a softening agent, there may be a problem such that the aliphatic ester may readily be hydrolyzed during its storage.

DISCLOSURE OF THE INVENTION

According to one aspect of the present invention, it may be possible to provide a fixation fluid, including a softening agent(s), the softening agent(s) being a saturated aliphatic carboxylic acid ester(s) of a saturated aliphatic alcohol(s) and/or a carbonic acid ester(s) of a dihydric saturated aliphatic alcohol(s), a foaming agent(s), the foaming agent(s) being a non-ionic surfactant(s) and/or an amphoteric surfactant(s), water, a pH adjustor(s), the pH adjustor(s) being an acid(s) and/or a salt(s) of the acid(s), and a pH of the fixation fluid being 6 or more and 7 or less.

According to another aspect of the present invention, it may be possible to provide a fixation method, including a step of foaming the fixation fluid as described above and a step of providing the foamed fixation fluid to a particle(s) including a resin(s) to fix the particle(s) on a medium.

According to another aspect of the present invention, it may be possible to provide an image forming method, including the particle(s) being a toner(s), a step of forming an electrostatic latent image on an electrostatic latent image carrier, a step of developing an electrostatic latent image formed on the electrostatic latent image carrier by using a developer including the toner(s) to form a toner image, a step of transferring a toner image formed on the electrostatic latent image carrier to a medium, and a step of fixing a toner image transferred to the medium by using the fixation method as described above.

According to another aspect of the present invention, it may be possible to provide an image forming method, including the particle(s) being a toner(s), a step of forming an electrostatic latent image on an electrostatic latent image carrier, a step of developing an electrostatic latent image formed on the electrostatic latent image carrier by using a developer including the toner(s) to form a toner image, a step of transferring a toner image formed on the electrostatic latent image carrier to an intermediate transfer body, a step of transferring a toner image transferred to the intermediate transfer body to a medium, and a step of fixing a toner image transferred to the medium by using the fixation method as described above.

According to another aspect of the present invention, it may be possible to provide a fixation device, including a part configured to foam the fixation fluid as described above and a part configured to provide the foamed fixation fluid to a particle(s) including a resin(s) to fix the particle(s) on a medium.

According to another aspect of the present invention, it may be possible to provide an image forming apparatus, including the particle(s) being a toner(s), a part configured to form an electrostatic latent image on an electrostatic latent image carrier, a part configured to develop an electrostatic latent image formed on the electrostatic latent image carrier by using a developer including the toner(s) to form a toner image, a part configured to transfer a toner image formed on the electrostatic latent image carrier to a medium, and a part configured to fix a toner image transferred to the medium by using the fixation device as described above.

According to another aspect of the present invention, it may be possible to provide an image forming apparatus, including the particle(s) being a toner(s), a part configured to form an electrostatic latent image on an electrostatic latent image carrier, a part configured to develop an electrostatic latent image formed on the electrostatic latent image carrier by using a developer including the toner(s) to form a toner image, a part configured to transfer a toner image formed on the electrostatic latent image carrier to an intermediate transfer body, a part configured to transfer a toner image transferred to the intermediate transfer body to a medium, and a part configured to fix a toner image transferred to the medium by using the fixation device as described above.

EXPLANATION OF LETTERS OR NUMERALS

Figure 1:
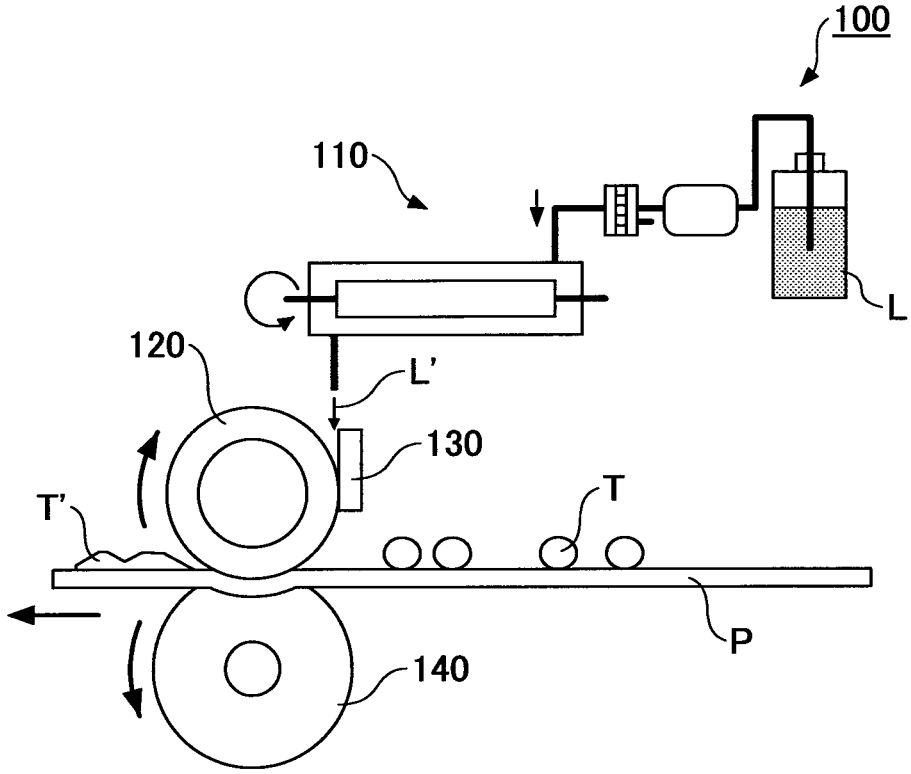
FIG. 1 is a diagram illustrating one example of a fixation device according to an illustrative embodiment of the present invention.

100: Fixation device
100': Fixation device
110: Fixation fluid foaming device
120: Application roller
130: Blade
140: Pressurizing roller
140': Pressurizing belt
L: Fixation fluid
L': Foamed fixation fluid
P: Recording paper sheet
T: Unfixed toner image
T': Fixed toner image

BEST MODE FOR CARRYING OUT THE INVENTION

At least one embodiment of the present invention may relate to at least one of a fixation fluid, fixation method, image forming method, fixation device and image forming apparatus in which a particle(s) containing a resin(s) may be fixed on a medium.

At least one embodiment of the present invention may aim at providing at least one of, a fixation fluid which may be excellent in its foaming property and storage stability, and a fixation method, image forming method, fixation device and image forming apparatus which may use the fixation fluid, while a problem(s) possessed by the above-mentioned conventional technique(s) may be taken into consideration.

A first embodiment of the present invention is a fixation fluid which contains a softening agent(s), a foaming agent(s), water, and a pH adjustor(s) and whose pH is 6 or more and 7 or less, characterized in that the softening agent(s) is/are a saturated aliphatic carboxylic acid ester(s) of a saturated aliphatic alcohol(s) and/or a carbonic acid ester(s) of a dihydric saturated aliphatic alcohol(s), the foaming agent(s) is/are a non-ionic surfactant(s) and/or an amphoteric surfactant(s), and the pH adjustor(s) is/are an acid(s) and/or a salt(s) of the acid(s).

A second embodiment of the present invention is the fixation fluid according to the first embodiment of the present invention, characterized in that the non-ionic surfactant(s) is/are an alkylglycoside(s) having an alkyl group whose carbon number is 12 or more and 18 or less.

A third embodiment of the present invention is the fixation fluid according to the first or second embodiment of the present invention, characterized in that the amphoteric surfactant(s) is/are one or more kinds selected from the group consisting of fatty amido propyl dimethyl aminoacetate betaines derived from fatty acids whose carbon numbers are 12 or more and 18 or less, alkyl dimethyl aminoacetate betaines having an alkyl group whose carbon number is 12 or more and 18 or less, N-acylsarcosines having an acyl group whose carbon number is 12 or more and 18 or less, salts of the N-acylsarcosines, N-fatty-acid-acylglutamic acids derived from fatty acids whose carbon numbers are 12 or more and 18 or less, and salts of the N-fatty-acid-acylglutamic acids.

A fourth embodiment of the present invention is the fixation fluid according to any one of the first to third embodiments of the present invention, characterized by further containing a saturated aliphatic monocarboxylic acid(s) whose carbon number(s) is/are 12 or more and 18 or less and/or a saturated aliphatic monoalcohol(s) whose carbon number(s) is/are 12 or more and 18 or less.

A fifth embodiment of the present invention is the fixation fluid according to any one of the first to fourth embodiments of the present invention, characterized by further containing a hydrolysis product(s) of the ester(s).

A sixth embodiment of the present invention is a fixation method characterized by including a step of foaming the fixation fluid according to any one of the first to fifth embodiments of the present invention and a step of providing the foamed fixation fluid to a particle(s) containing a resin(s) so as to fix it/them on a medium.

A seventh embodiment of the present invention is an image forming method characterized by including the particle(s) being a toner(s), a step of forming an electrostatic latent image on an electrostatic latent image carrier, a step of developing an electrostatic latent image formed on the electrostatic latent image carrier by using a developer containing the toner(s) so as to form a toner image, a step of transferring a toner image formed on the electrostatic latent image carrier to a medium, and a step of fixing a toner image transferred to the medium by using the fixation method according to the sixth embodiment of the present invention.

An eighth embodiment of the present invention is an image forming method characterized by including the particle(s) being a toner(s), a step of forming an electrostatic latent image on an electrostatic latent image carrier, a step of developing an electrostatic latent image formed on the electrostatic latent image carrier by using a developer containing the toner(s) so as to form a toner image, a step of transferring a toner image formed on the electrostatic latent image carrier to an intermediate transfer body, a step of transferring a toner image transferred to the intermediate transfer body to a medium, and a step of fixing a toner image transferred to the medium by using the fixation method according to the sixth embodiment of the present invention.

A ninth embodiment of the present invention is a fixation device characterized by including means of foaming the fixation fluid according to any one of the first to fifth embodiments of the present invention and means of providing the foamed fixation fluid to a particle(s) containing a resin(s) so as to fix it/them on a medium.

A tenth embodiment of the present invention is an image forming apparatus characterized by including the particle(s) being a toner(s), means of forming an electrostatic latent image on an electrostatic latent image carrier, means of developing an electrostatic latent image formed on the electrostatic latent image carrier by using a developer containing the toner(s) so as to form a toner image, means of transferring a toner image formed on the electrostatic latent image carrier to a medium, and means of fixing a toner image transferred to the medium by using the fixation device according to the ninth embodiment of the present invention.

An eleventh embodiment of the present invention is an image forming apparatus characterized by including the particle(s) being a toner(s), means of forming an electrostatic latent image on an electrostatic latent image carrier, means of developing an electrostatic latent image formed on the electrostatic latent image carrier by using a developer containing the toner(s) so as to form a toner image, means of transferring a toner image formed on the electrostatic latent image carrier to an intermediate transfer body, means of transferring a toner image transferred to the intermediate transfer body to a medium, and means of fixing a toner image transferred to the medium by using the fixation device according to the ninth embodiment of the present invention.

According to at least one embodiment of the present invention, it may be possible to provide at least one of, a fixation fluid which may be excellent in its foaming property and storage stability, and a fixation method, image forming method, fixation device and image forming apparatus which may use the fixation fluid.

Next, at least one illustrative embodiment of the present invention will be described with reference to the drawings.

A fixation fluid according to an illustrative embodiment of the present invention contains a softening agent(s), a foaming agent(s), water, and a pH adjustor(s), and its pH is 6-7. Herein, the softening agent(s) is/are a saturated aliphatic carboxylic acid ester(s) of a saturated aliphatic alcohol(s) and/or a carbonic acid ester(s) of a dihydric saturated aliphatic alcohol(s), the foaming agent(s) is/are a non-ionic surfactant(s) and/or an amphoteric surfactant(s), and the pH adjustor(s) is/are an acid(s) and/or a salt(s) of the acid(s). Thereby, it may be possible to obtain a fixation fluid that may be excellent in its foaming property and storage stability. If the pH of the fixation fluid is less than 6 or more than 7, the softening agent(s) may be readily hydrolyzed, and accordingly, the storage stability may be degraded. Additionally, in the fixation fluid according to an illustrative embodiment of the present invention, the softening agent(s) may dissolve or swell at least a portion of a particle(s) containing a resin(s) (referred to as a rein particle(s) below) whereby it may be possible to soften the resin particle(s), and as a result, it may be possible to fix the resin particle(s) on a medium.

The pH adjustor(s) is/are not particularly limited and it may be possible to provide acetic acid, sodium acetate, potassium acetate, lactic acid, sodium lactate, potassium lactate, citric acid, sodium citrate, potassium citrate, and the like, wherein two or more kinds thereof may be used in combination.

The non-ionic surfactant(s) is/are particularly limited and it may be possible to provide alkylglucosides having an alkyl group whose carbon number is 12-18 such as decylglucoside and laurylglucoside and the like, wherein two or more kinds thereof may be used in combination. If the carbon number is less than 12 or more than 18, the foaming property may be degraded.

The amphoteric surfactant(s) is/are not particularly limited and it may be possible to provide fatty amido propyl dimethyl amino acetate betaines derived from fatty acids whose carbon numbers are 2-18 such as myristic amido propyl dimethyl amino acetate betaine; alkyl dimethyl amino acetate betaines having an alkyl group whose carbon number is 12-18 such as stearyl dimethyl amino acetate betaine; N-acylsarcosines having an acyl group whose carbon number is 12-18 and salts thereof, such as sodium lauroyl sarcosine, sodium myristoyl sarcosine, and sodium palmitoyl sarcosine; N-acylglutamic acids having an acyl group whose carbon number is 12-18 and salts thereof, such as sodium myristoylglutamate and sodium palm fatty acid glutamate; and the like, wherein two or more kinds thereof may be used in combination. If the carbon number(s) is/are less than 12 or more than 18, the foaming property may be degraded.

In regard to a fixation fluid according to an illustrative embodiment of the present invention, it may be preferable to further contain a saturated aliphatic monocarboxylic acid(s) whose carbon number(s) is/are 12-18 and/or a saturated aliphatic monoalcohol(s) whose carbon number(s) is/are 12-18, and it may be particularly preferable to further contain a saturated aliphatic monoalcohol(s) whose carbon number(s) is/are 12-18. Thereby, it may be possible to improve its foaming property and foam stability, and accordingly, it may be possible to apply a small amount of the fixation fluid to a resin particle(s) stably so as to fix it/them on a medium. If the carbon number(s) is/are less than 12 or more than 18, the effect of improving the foaming property and foam stability may be degraded.

The saturated aliphatic monocarboxylic acid(s) whose carbon number(s) is/are 12-18 is/are not particularly limited and it may be possible to provide lauric acid, tridecylic acid, myristic acid, palmitic acid, margaric acid, stearic acid, and the like, wherein two or more kinds thereof may be used in combination.

The saturated aliphatic monoalcohol(s) whose carbon number(s) is/are 12-18 is/are not particularly limited and it may be possible to provide lauryl alcohol, tridecyl alcohol, myristyl alcohol, palmityl alcohol, margaryl alcohol, stearyl alcohol, and the like, wherein two or more kinds thereof may be used in combination.

It may be preferable that the content of the saturated aliphatic monocarboxylic acid(s) whose carbon number(s) is/are 12-18 and/or saturated aliphatic monoalcohol(s) whose carbon number(s) is/are 12-18 in the fixation fluid is 0.2-0.4% by mass. If this content is less than 0.2% by mass, the effect of improving its foaming property and foam stability may be degraded.

In regard to a fixation fluid according to an illustrative embodiment of the present invention, it may be preferable to further contain a hydrolysis product(s) of the softening agent(s). Thereby, it may be possible to further suppress hydrolysis of the softening agent(s), and accordingly, it may be possible to improve the storage stability of the fixation fluid. Furthermore, it may be possible to increase the amount of the softening agent(s) dissolved in the fixation fluid. In particular, polyhydric saturated aliphatic alcohols such as ethylene glycol, diethylene glycol, propylene glycol, 1,3-butylene glycol, and glycerin, may have a large effect of increasing the amount of the softening agent(s) dissolved in the fixation fluid. Herein, when the softening agent(s) is/are a saturated aliphatic carboxylic acid ester(s) of a saturated aliphatic alcohol(s), the hydrolysis product(s) of the softening agent(s) is/are a saturated aliphatic carboxylic acid(s) and a saturated aliphatic alcohol(s). Furthermore, when the softening agent(s) is/are a carbonic acid ester(s) of a dihydric saturated aliphatic alcohol(s), the hydrolysis product(s) of the softening agent(s) is/are carbonic acid (or carbon dioxide) and/or a dihydric saturated aliphatic alcohol(s). Additionally, when carbonic acid (or carbon dioxide) and/or a saturated aliphatic carboxylic acid(s) is/are added as a hydrolysis product(s) of the softening agent(s), it may only be necessary to add it/them such that the pH of the fixation fluid is in a range of 6-7. Furthermore, when a saturated aliphatic alcohol(s) is/are added as a hydrolysis product(s) of the softening agent(s), it may be preferable that the content of the saturated aliphatic alcohol(s) in the fixation fluid is 1-30% by mass. If this content is less than 1% by mass, the effect of suppressing hydrolysis of the softening agent(s) may be degraded, and if it is more than 30% by mass, the foaming property of the fixation fluid may be degraded.

In an illustrative embodiment of the present invention, it may be preferable that the acute oral toxicity LD50 of the softening agent(s) is more than 3 g/kg, and it may be more preferable to be more than 5 g/kg, from the viewpoint of safety to a human body. Furthermore, when a fixation fluid according to an illustrative embodiment of the present invention is used for fixation, it may be preferable to involve no generation of unpleasant odor. That is, it may be preferable for the softening agent(s) to involve no volatile organic compound (VOC) that may cause unpleasant odor. Additionally, it may be possible for an index of odor to be an odor index represented by the formula:

10× log (a dilution rate of a substance at which no odor of the substance is detected), which is measured by using a three-point comparative odor bag method that is a sensory measurement, as a practical measurement scale of odor whereby odor in the environment of an office or the like may be measured at a high precision. Herein, it may be preferable for the softening agent(s) to have an index of odor of 10 or less. If the index of odor is more than 10, unpleasant odor may be generated in a normal office environment.

In an illustrative embodiment of the present invention, it may be preferable that the saturated aliphatic carboxylic acid ester(s) of a saturated aliphatic alcohol(s) include(s) a monoester(s) represented by the general formula:

$$R^1COOR^2$$

(in the formula, $R^1$ is an alkyl group whose carbon number is 11-14 and $R^2$ is a linear or branched alkyl group whose carbon number is 1-6.). Thereby, it may be possible to dissolve or swell a resin particle(s) in a short time. Specifically, when the resin particle(s) is/are toner, it may be possible that a time period from application of a fixation fluid to an unfixed toner image formed on a recording medium to fixation of the toner image in a high-speed printing at about 60 ppm is 1 second or less. Furthermore, it may be possible for such a monoester(s) to reduce stickiness of a toner image. It is considered that this may be because the monoester(s) form(s) an oil film on the surface of an image of a dissolved or swelled toner. Herein, if the carbon number of $R^1$ is less than 11, the index of order may be more than 10. Furthermore, if the carbon number of $R^1$ is more than 14 or the carbon number of $R^2$ is more than 6, its ability of dissolving or swelling a resin particle(s) may be degraded.

Such a monoester(s) is/are not particularly limited and it may be possible to provide ethyl laurate, hexyl laurate, ethyl tridecylate, isopropyl tridecylate, ethyl myristate, isopropyl myristate, and the like, wherein two or more kinds thereof may be used in combination.

Furthermore, it may be preferable that the saturated aliphatic carboxylic acid ester(s) of a saturated aliphatic alcohol(s) include(s) a diester(s) represented by the general formula:

$$R^3(COOR^4)_2$$

(in the formula, $R^3$ is an alkylene group whose carbon number is 3-8 and $R^4$ is a linear or branched alkyl group whose carbon number is 3-5.). Thereby, it may be possible to dissolve or swell a resin particle(s) in a shorter time. Specifically, when the resin particle(s) is/are toner, it may be possible that a time period from application of a fixation fluid to an unfixed toner image formed on a recording medium to fixation of the toner image in a high-speed printing at about 60 ppm is 0.1 second or less. Furthermore, it may be possible to reduce the content(s) of the softening agent(s) in the fixation fluid. Herein, if the carbon number of $R^3$ is less than 3 or the carbon number of $R^4$ is less than 3, the index of order may be more than 10. Furthermore, if the carbon number of $R^3$ is more than 8 or the carbon number of $R^4$ is more than 5, its ability of dissolving or swelling a resin particle(s) may be degraded.

Such a diester(s) is/are not particularly limited and it may be possible to provide 2-ethylhexyl succinate, dibutyl adipate, diisobutyl adipate, diisobutyl adipate, diisodecyl adipate, diethyl sebacate, dibutyl sebacate, and the like, wherein two or more kinds thereof may be used in combination.

Moreover, it may be preferable that the saturated aliphatic carboxylic acid ester(s) of a saturated aliphatic alcohol(s) include(s) a diester(s) represented by the general formula:

$$R^5(COOR^6OR^7)_2$$

(in the formula, $R^5$ is an alkylene group whose carbon number is 2-8, $R^6$ is an alkylene group whose carbon number is 2-4, and $R^7$ is an alkyl group whose carbon number is 1-4.). Thereby, it may be possible to dissolve or swell a resin particle(s) in a shorter time. Specifically, when the resin particle(s) is/are toner, it may be possible that a time period from application of a fixation fluid to an unfixed toner image formed on a recording medium to fixation of the toner image in a high-speed printing at about 60 ppm is 0.1 second or less. Furthermore, it may be possible to reduce the content(s) of the softening agent(s) in the fixation fluid. Herein, if the carbon number of $R^5$ is 1 or the carbon number of $R^6$ is 1, the index of order may be more than 10. Furthermore, if the carbon number of $R^5$ is more than 8, the carbon number of $R^6$ is more than 4, or the carbon number of $R^7$ is more than 4, its ability of dissolving or swelling a resin particle(s) may be degraded.

Such a diester(s) is/are not particularly limited and it may be possible to provide di(ethoxyethyl) succinate, di(butoxyethyl) succinate, di(methoxyethyl) adipate, di(ethoxyethyl) adipate, di(butoxyethyl) adipate, di(ethoxyethyl) sebacate, and the like, wherein two or more kinds thereof may be used in combination.

In addition, it may be preferable that the saturated aliphatic carboxylic acid ester(s) of a saturated aliphatic alcohol(s) include(s) a diester(s) represented by the general formula:

$$R^9(COOR^9OR^{10}OR^{11})_2$$

(in the formula, $R^8$ is an alkylene group whose carbon number is 2-8, each of $R^9$ and $R^{10}$ is independently an alkylene group whose carbon number is 2 or 3, and $R^{11}$ is an alkyl group whose carbon number is 1-4.). Thereby, it may be possible to dissolve or swell a resin particle(s) in a shorter time. Specifically, when the resin particle(s) is/are toner, it may be possible that a time period from application of a fixation fluid to an unfixed toner image formed on a recording medium to fixation of the toner image in a high-speed printing at about 60 ppm is 0.1 second or less. Furthermore, it may be possible to reduce the content(s) of the softening agent(s) in the fixation fluid. Herein, if the carbon number of $R^8$ is 1, the carbon number of $R^9$ is 1, or the carbon number of $R^{10}$ is 1, the index of order may be more than 10. Furthermore, if the carbon number of $R^8$ is more than 8, the carbon number of $R^9$ is more than 3, the carbon number of $R^{10}$ is more than 3, or the carbon number of $R^{11}$ is more than 4, its ability of dissolving or swelling a resin particle(s) may be degraded.

Such a diester(s) is/are not particularly limited and it may be possible to provide di(ethoxyethoxyethyl) succinate, di(methoxyethoxyethyl) succinate, di(methoxyethoxyethyl) adipate, di(ethoxyethoxyethyl) sebacate, and the like, wherein two or more kinds thereof may be used in combination.

Furthermore, it may be preferable that the saturated aliphatic carboxylic acid ester(s) of a saturated aliphatic alcohol(s) include(s) a diester(s) represented by the general formula:

$$R^{12}(OCOR^{13})_2$$

(in the formula, $R^{12}$ is an alkylene group whose carbon number is 2-8 and $R^{13}$ is a linear or branched alkyl group whose carbon number is 2-5.). Thereby, it may be possible to dissolve or swell a resin particle(s) in a shorter time. Specifically, when the resin particle(s) is/are toner, it may be possible that a time period from application of a fixation fluid to an unfixed toner image formed on a recording medium to fixation of the toner image in a high-speed printing at about 60 ppm is 0.1 second or less. Furthermore, it may be possible to reduce the content(s) of the softening agent(s) in the fixation fluid. Herein, if the carbon number of $R^{12}$ is 1 or the carbon number of $R^{13}$ is 1, the index of order may be more than 10. Furthermore, if the carbon number of $R^{12}$ is more than 8 or the carbon number of $R^{13}$ is more than 5, its ability of dissolving or swelling a resin particle(s) may be degraded.

Such a diester(s) is/are not particularly limited and it may be possible to provide ethylene glycol diacetate, ethylene glycol dipropionate, propylene glycol diacetate, propylene glycol dibutyrate, butylene glycol dibutyrate, and the like, wherein two or more kinds thereof may be used in combination.

Moreover, it may be preferable that the saturated aliphatic carboxylic acid ester(s) of a saturated aliphatic alcohol(s) include(s) a diester(s) represented by the general formula:

$$R^{14}(OR^{15}OCOR^{16})_2$$

(in the formula, $R^{14}$ is an alkylene group whose carbon number is 2-4, $R^{15}$ is a linear or branched alkylene group whose carbon number is 2 or 3, and $R^{16}$ is an alkyl group whose carbon number is 1-4.). Thereby, it may be possible to dissolve or swell a resin particle(s) in a shorter time. Specifically, when the resin particle(s) is/are toner, it may be possible that a time period from application of a fixation fluid to an unfixed toner image formed on a recording medium to fixation of the toner image in a high-speed printing at about 60 ppm is 0.1 second or less. Furthermore, it may be possible to reduce the content(s) of the softening agent(s) in the fixation fluid. Herein, if the carbon number of $R^{14}$ is 1 or the carbon number of $R^{15}$ is 1, the index of order may be more than 10. Furthermore, if the carbon number of $R^{14}$ is more than 4, the carbon number of $R^{15}$ is more than 3, or the carbon number of $R^{16}$ is more than 4, its ability of dissolving or swelling a resin particle(s) may be degraded.

Such a diester(s) is/are not particularly limited and it may be possible to provide triethylene glycol diacetate, triethylene glycol dipropionate, tripropylene glycol diacetate, and the like, wherein two or more kinds thereof may be used in combination.

In an illustrative embodiment of the present invention, it may be preferable that the carbonic acid ester(s) of a dihydric saturated aliphatic alcohol(s) is a compound(s) represented by the general formula:

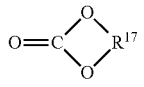

(in the formula, $R^{17}$ is an alkylene group.). Thereby, it may be possible to dissolve or swell a resin particle(s) in a short time. Specifically, when the resin particle(s) is/are toner, it may be possible that a time period from application of a fixation fluid to an unfixed toner image formed on a recording medium to fixation of the toner image in a high-speed printing at about 60 ppm is 1 second or less. Furthermore, it may be possible for such a carbonic acid ester(s) to reduce stickiness of a toner image. It is considered that this may be because the carbonic acid ester(s) form(s) an oil film on the surface of an image of a dissolved or swelled toner.

Such a carbonic acid ester(s) is/are not particularly limited and it may be possible to provide ethylene carbonate, propylene carbonate, butylene carbonate, and the like, wherein two or more kinds thereof may be used in combination.

Furthermore, it may be preferable for the fixation fluid to have an affinity with a resin particle(s). Herein, the affinity means the degree of spreading wetting of a liquid on the surface of a solid when the liquid contacts the solid. When the resin particle(s) is/are a water-repellent toner that has been treated with a hydrophobic particle(s) such as hydrophobic silicas and hydrophobic titanium oxides, it may be estimated that its surface free energy per unit area is 20-30 $mJ/m^2$. Accordingly, it may be preferable that the surface tension of the fixation fluid is 20-30 mN/m.

Moreover, it may be preferable that the fixation fluid is an emulsion. Thereby, it may be possible to improve its permeability to a resin particle(s) and/or suppress curl of a medium such as a paper sheet.

Additionally, when the fixation fluid is prepared, it may be preferable that a shear stress is applied by using a homomixer, a homogenizer, an ultrasonic homogenizer, or the like such that the softening agent(s) is/are dissolved or dispersed.

In an illustrative embodiment of the present invention, the resin particle(s) is/are not particularly limited and it may be possible to provide, for example, a toner that contains a resin(s), a release agent(s), and the like, a particle(s) that contains a resin(s), an electrically conductive material(s), and the like.

The resin(s) contained in a toner is/are not particularly limited and it may be possible to provide polystyrenes, styrene-acryl copolymers, polyesters, and the like, wherein two or more kinds thereof may be used in combination.

The release agent(s) is/are not particularly limited and it may be possible to provide carnauba waxes, polyethylene waxes, and the like, wherein two or more kinds thereof may be used in combination.

The toner may include a publicly known coloring agent(s), charge control agent(s), or the like, in addition to the resin(s) and the release agent(s). Furthermore, it may be preferable that the toner is a water-repellent toner treated by fixing a hydrophobic particle(s) such as hydrophobic silicas and hydrophobic titanium oxides which have a methyl group(s) onto a toner surface.

Furthermore, the medium is not particularly limited and it may be possible to provide paper, fabric, and resin sheets, metal plates, ceramic plates, and the like. Herein, it may be preferable that the medium has a fixation fluid-permeating property. For such a medium, it may be possible to provide ones having a fixation fluid-permeating property and ones on which a layer having a fixation fluid-permeating property is formed. Moreover, a three-dimensional object having a plane surface or curved surface or the like may be used for the medium.

It may also be possible to apply a fixation fluid according to an illustrative embodiment of the present invention to, for example, applications such as varnish coats wherein a transparent resin particle(s) is/are fixed on a medium such as a paper sheet to protect it.

A fixation method according to an illustrative embodiment of the present invention includes a step of foaming a fixation fluid according to an illustrative embodiment of the present invention and a step of applying the foamed fixation fluid to a resin particle(s) so as to fix it/them on a medium.

In an illustrative embodiment of the present invention, it may be preferable that the bulk density of the foamed fixation fluid is 0.01-0.1 g/cm$^3$, wherein 0.01-0.05 g/cm$^3$ is more preferable and 0.025-0.05 g/cm$^3$ is particularly preferable. If the bulk density is less than 0.01 g/cm$^3$, application of the fixation fluid may be insufficient, and if it is more than 0.1 g/cm$^3$, a feeling of a residual fluid on a medium may be provided when the fixation fluid is applied.

Furthermore, it may be preferable that the size(s) of a bubble(s) in the foamed fixation fluid is/are 5-50 μm. Thereby, it may be possible to apply the foamed fixation fluid to a resin particle(s) without disturbing the resin particle(s) with a particle size of 5-10 μm formed on the medium.

FIG. 1 illustrates one example of a fixation device according to an illustrative embodiment of the present invention. A fixation device 100 includes a fixation fluid foaming device 110 for foaming a fixation fluid L, an application roller 120 for carrying a fixation fluid L' foamed by the fixation fluid foaming device 110 and applying it to an unfixed toner image T, a blade 130 for controlling the film thickness of the foamed fixation fluid L' carried on the surface of the application roller 120, and a pressurizing roller 140 for opposing the application roller 120 and pressurizing a recording paper sheet P conveyed between it and the application roller 120. Additionally, the foamed fixation fluid L' is dropped between the application roller 120 and the blade 130. Herein, because the bulk density of the foamed fixation fluid L' is small, it may be possible to increase its film thickness on the application roller 120. As a result, it may be possible to apply the foamed fixation fluid L' to the unfixed toner image T sufficiently and it may be possible to fix the unfixed toner image T. Furthermore, it may be possible to suppress generation of a feeling of residual fluid on the recording paper sheet P on which a fixed toner image T' is formed. Furthermore, because it may be possible for the foamed fixation fluid L' to suppress the influence of its surface tension, it may be possible to suppress offset of a toner onto the application roller 120.

Additionally, the film thickness of the foamed fixation fluid L' is appropriately selected depending on the thickness of the unfixed toner image T formed on the recording paper sheet P, the size(s) of a bubble(s) of the foamed fixation fluid L', its viscosity, a pressure when it is applied to the unfixed toner image T, and an environmental temperature.

Figure 2:
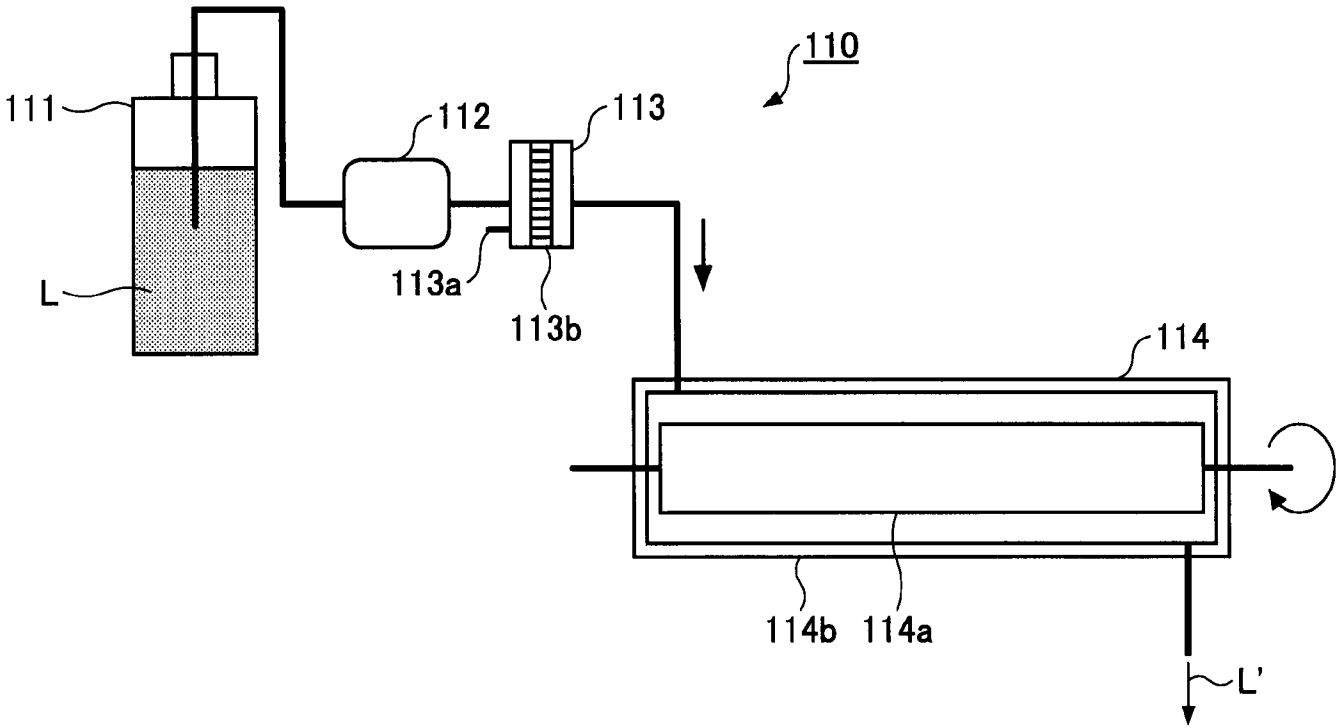
FIG. 2 is a diagram illustrating a fixation fluid foaming device in FIG. 1.

As illustrated in FIG. 2, the fixation fluid foaming device 110 includes a container 111 for containing a fixation fluid L, a pump 112 for delivering the fixation fluid L from the container 111, a coarse and large bubble creating part 113 for creating a coarse and large bubble(s) with a bubble size of 0.5-1 mm in the delivered fixation fluid L, and a fine bubble creating part 114 for applying a shear force to the fixation fluid L in which the coarse and large bubble(s) is/are created whereby the coarse and large bubble(s) is/are divided to create a fine bubble(s). Thereby, it may be possible to a create fine bubble(s) with a bubble size(s) of 5-50 μm in the fixation fluid L in a very short time so that it may be possible to obtain the foamed fixation fluid L'.

The pump 112 is not particularly limited and it may be possible to provide a gear pump, a bellows pump, and the like, wherein a tube pump is preferable. Because the fixation fluid L in a tube of a tube pump is pushed out by deforming the tube, only the tube is a member contacting the fixation fluid L. Thereby, it may be possible to suppress contamination of the fixation fluid L and/or degradation of a component of the pump by using a tube having a fluid resistance to the fixation fluid L. Furthermore, because it may be only necessary to deform the tube, it may be possible to suppress foaming of the fixation fluid L and it may be possible to suppress degradation of its delivering ability.

The coarse and large bubble creating part 113 is provided with an air vent 113*a* and a micropore sheet 113*b* with a pore size of 30-100 μm. Herein, the fixation fluid L is delivered and a negative pressure is generated at the air vent 113*a* so that air introduced from the air vent 113*a* is mixed with the fixation fluid L. Furthermore, the fixation fluid L mixed with the air passes through the micropore sheet 113*b* whereby a coarse and large bubble(s) with a uniform bubble size is/are created.

Additionally, a porous member having an open-cell foam structure with a pore size of 30-100 μm may be used instead of the micropore sheet 113*b*. Such a porous member is not particularly limited and it may be possible to provide sintered ceramic plates, non-woven fabrics, foamed resin sheets, and the like.

Furthermore, instead of providing the coarse and large bubble creating part 113 with the air vent 113*a* and the micropore sheet 113*b*, a blade-shaped stirrer may be used to stir the fixation fluid L whereby a coarse and large bubble(s) may be created while the fixation fluid L is involved with an air bubble(s), or the fixation fluid L may be bubbled by using an air supply pump or the like whereby a coarse and large bubble(s) may be created.

The fine bubble creating part 114 is a closed double cylinder composed of a rotatable inner cylinder 114*a* and an outer cylinder 114*b*. Herein, the fixation fluid L in which a coarse and large bubble(s) is/are created is supplied from a part of the outer cylinder 114*b* and passes through the gap between the inner cylinder 114*a* that is rotating and the outer cylinder 114*b* whereby a shear force is applied thereto. Thereby, a coarse and large bubble(s) is/are divided to create fine bubbles and the foamed fixation fluid L' is discharged from a part of the outer cylinder 114*b*. Then, the inner cylinder 114*a* may be provided with a spiral-shaped groove to improve the ability of delivering the fixation fluid in which a coarse and large bubble(s) is/are created in the fine bubble creating part 114.

Figure 3A:
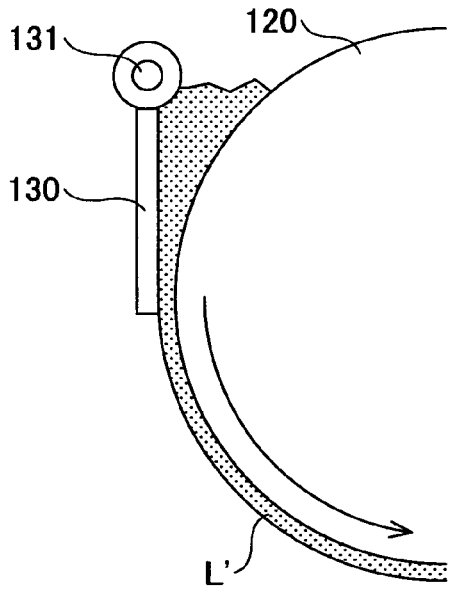
FIG. 3A and FIG. 3B are diagrams illustrating a blade in FIG. 1.
Figure 3B:
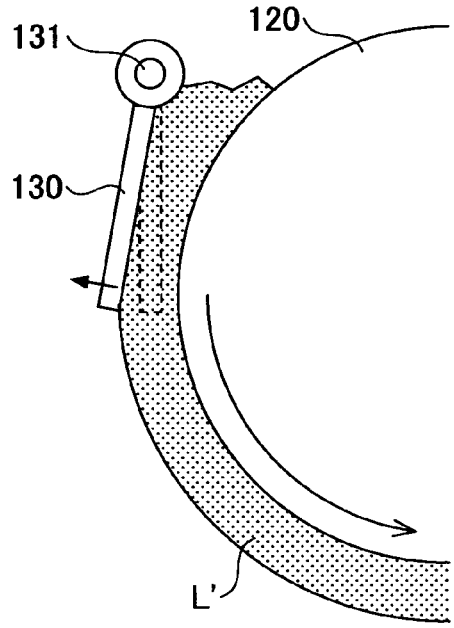

As illustrated in FIG. 3A and FIG. 3B, the blade 130 is separated by a gap of 10-100 μm from the application roller 120 by means of a shaft 131 provided on an end portion thereof. Then, when the film thickness of the foamed fixation fluid L' is reduced, the gap is made small (see FIG. 3A), and when the film thickness of the foamed fixation fluid L' is increased, the gap is made large (see FIG. 3B).

Additionally, a wire bar may be used instead of the blade 130. Thereby, it may be possible to improve the uniformity of the film thickness of the foamed fixation fluid L' in the axial direction of the application roller.

The pressurizing roller 140 is configured by using a sponge (elastic porous body) which may be capable of being greatly deformed by a weak pressure, as an elastic layer. Thereby, it may be possible to ensure a nipping time of 50-300 milliseconds. Herein, it may be necessary to adjust the nipping time such that the recording paper sheet P is released from the application roller 120 after the foamed fixation fluid L' permeates through the unfixed toner image T to reach the recording paper sheet P.

Additionally, the nipping time is the ratio of a nip width to the conveyance velocity of the recording paper sheet P. Then, it may be possible to obtain the conveyance velocity of the recording paper sheet P from design data of a paper sheet conveyance driving mechanism. Furthermore, it may be possible to obtain the nip width by applying a colored coating material on the entire surface of the application roller 120 thinly, then nipping the recording paper sheet P between the application roller 120 and the pressurizing roller 140 opposing thereto so as to pressurize it and make the colored coating material adhere to the recording paper sheet P, and measuring the length of the colored coating material adhering to the recording paper sheet P in the direction of paper sheet conveyance.

Hence, it may be necessary to adjust the nip width depending on the conveyance velocity of the recording paper sheet P and it may be possible to change the distance between the axes of the application roller 120 and pressurizing roller 140 so as to adjust the nip width.

The sponge is a material that is completely or substantially insoluble or non-swellable in the softening agent(s) and the surface of the sponge may be covered with a flexible film that is completely or substantially insoluble or non-swellable in the softening agent(s). The material of the sponge is not particularly limited and it may be possible to provide polyethylenes, polypropylenes, polyamides, and the like. Furthermore, the flexible film is not particularly limited and it may be possible to provide polyethylene terephthalates, polyethylenes, polypropylenes, tetrafluoroethylene-perfluoroalkyl vinyl ether copolymers (PFAs), and the like.

Additionally, an elastic rubber may be used instead of the sponge of the pressurizing roller 140.

Then, the fixation device 100 includes a device or means for detecting the leading end of the recording paper sheet P at the upstream side of the application roller 120 in the conveyance direction of the recording paper sheet P and it may be preferable that the foamed fixation fluid L' is configured on the application roller 120 such that the foamed fixation fluid L' is applied on only the recording paper sheet P depending on a detected signal. Thereby, it may be possible to suppress adhesion of the foamed fixation fluid L' from the application roller 120 to the pressurizing roller 140 during a waiting time in which none of the recording paper sheet(s) P has/have been conveyed, even though a configuration is provided such that the application roller 120 contacts the pressurizing roller 140 at all times.

Furthermore, the fixation device 100 may be configured to separate the application roller 120 from the pressurizing roller 140 during a waiting time in which none of the recording paper sheets P are conveyed and to contact the application roller 120 with the pressurizing roller 140 only when the foamed fixation fluid L' is applied on the recording paper sheet P by a driving mechanism. Herein, it may be preferable that a device or means for detecting the leading end of the recording paper sheet P is/are used in combination and the application roller 120 is contacted with the pressurizing roller 140 depending on a detected signal. Moreover, it may be preferable that a device or means for detecting the back end of the recording paper sheet P is/are provided and the application roller 120 is separated from the pressurizing roller 140 depending on a detected signal.

Furthermore, the fixation device 100 may include a pair of smoothing rollers (hard rollers) for pressurizing the recording paper sheet P on which a fixed toner image T' is formed. Thereby, it may be possible to smooth the surface of the fixed toner image T' and provide gloss thereto. Moreover, it may be possible to improve the fixation property of the fixed toner image T' on the recording paper sheet P.

Figure 4:
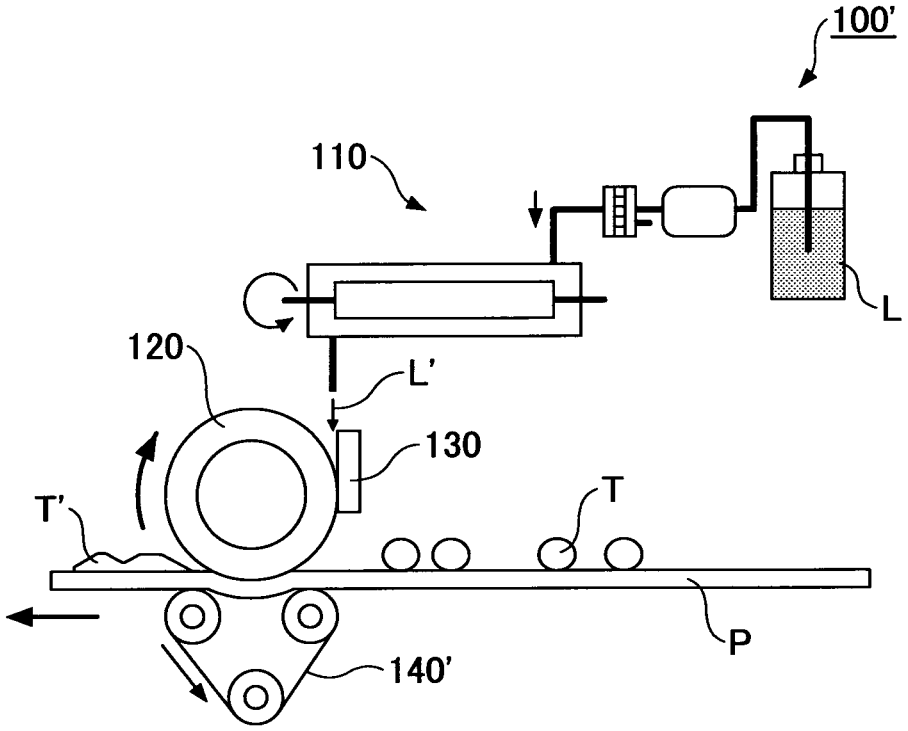
FIG. 4 is a diagram illustrating another example of a fixation device according to an illustrative embodiment of the present invention.

FIG. 4 illustrates another example of a fixation device according to an illustrative embodiment of the present invention. A fixation device 100' has the same configuration as that of the fixation device 100 except that a pressurizing belt 140' is used instead of the pressurizing roller 140. Thereby, it may be possible to increase the nip width readily.

The pressurizing belt 140' is not particularly limited and it may be possible to provide seamless nickel belts, belts in which a substrate such as a seamless PET is coated with a releasing fluororesin such as PFA.

Additionally, there may be provided a configuration such that a belt is used instead of the application roller 120 and a pressurizing roller 140 is used instead of the pressurizing roller 140' or a configuration such that a belt is used instead of the application roller 120.

Figure 5:
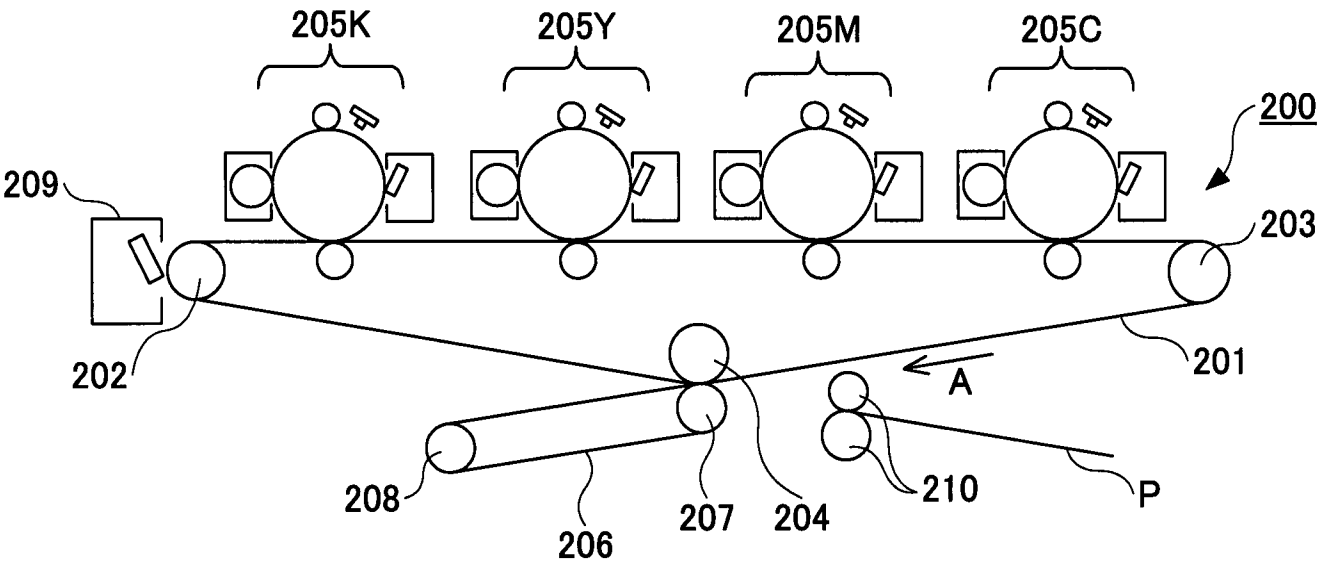
FIG. 5 is a diagram illustrating one example of an image forming apparatus according to an illustrative embodiment of the present invention.

FIG. 5 illustrates a tandem-type image forming apparatus 200 as one example of an image forming apparatus according to an illustrative embodiment of the present invention. Additionally, the image forming apparatus 200 may be a copying machine or a printer. The image forming apparatus 200 includes an intermediate transfer belt 201 on which an unfixed toner image T is transferred. The intermediate transfer belt 201 extends on three supporting rollers 202, 203, and 204 and moves in the direction of an arrow A. Black, yellow, magenta, and cyan image forming units 205K, 205Y, 205M, and 205C are each arranged with respect to the intermediate transfer belt 201. A light exposure device (not illustrated in the figure) is arranged above these image forming units. For example, when the image forming apparatus 200 is a copying machine, image information of an original copy is read by a scanner and exposure light L for writing an electrostatic latent image is radiated from a light exposure device (not illustrated in the figure) depending on the read image information. At a position opposing the supporting roller 204 by interposing the intermediate transfer belt 201, a transfer roller 207 is provided by interposing a conveyer belt 206. Additionally, the conveyer belt 206 extends on the transfer roller 207 and a supporting roller 208.

Furthermore, at a position opposing the supporting roller 202 by interposing the intermediate transfer belt 201, a cleaning device 209 for removing a toner remaining on the intermediate transfer belt 201 is provided.

Meanwhile, after a recording paper sheet P is paper-fed by using a pair of rollers 210, the conveyance belt 206 is pressed against the intermediate transfer belt 201 by using a transfer roller 208 whereby an unfixed toner image T is transferred to the recording paper sheet P. The recording paper sheet P to which the unfixed toner image T has been transferred is conveyed by the conveyer belt 206 to the fixation device 100 or 100' and the unfixed toner image T is fixed by the fixation device 100 or 100'. Herein, a foamed fixation fluid L' with a controlled film thickness is applied to the unfixed toner image T transferred to the recording paper sheet P based on information of an image from a light exposure device (not illustrated in the figure), for example, that of a color image or a black solid image.

Figure 6:
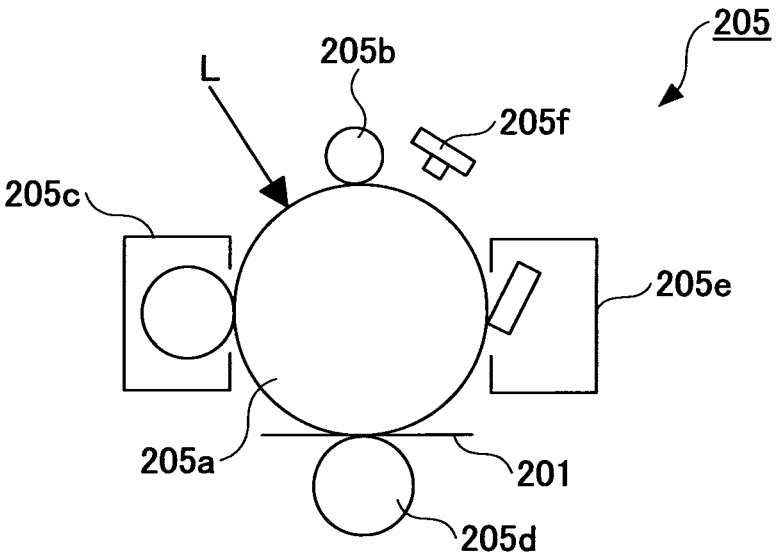
FIG. 6 is a diagram illustrating an image forming unit in FIG. 5.

As illustrated in FIG. 6, a charging roller 205*b*, a development device 205*c*, a transfer roller 205*d*, a cleaning device 205*e*, and a charge removing lamp 205*f* are arranged around a photoconductor drum 205*a* in each of the image forming units 205.

The charging roller 205*b* is a contact charging-type charging device, wherein the charging roller 205*b* is contacted with the photoconductor drum 205*a* and a voltage is applied between the photoconductor drum 205*a* and the charging roller 205*b* such that the surface of the photoconductor drum 205*a* is charged uniformly. Additionally, a non-contact charging-type charging device employing a non-contact scorotron or the like may be used instead of the charging roller 205*b*.

The development device 205*c* makes a toner in a developer adhere to an electrostatic latent image that is written on the photoconductor drum 205*a* by exposure light radiated from the light exposure device (not illustrated in the figure), so as to develop it whereby an unfixed toner image T is formed. Additionally, the development device 205*c* includes a stirring part (not illustrated in the figure) and a developing part (not illustrated in the figure) wherein a developer that has not been used for development is returned to the stirring part and then recycled. The density of a toner in the stirring part is detected by a sensor and the density of the toner is controlled so as to be constant.

The transfer roller 205*d* is provided at a position opposing the photoconductor drum 205*a* by interposing the intermediate transfer belt 201. Herein, the intermediate transfer belt 201 is pressed against the photoconductor drum 205*a* by using the transfer roller 205*d* whereby the unfixed toner image T formed on the photoconductor drum 205*a* is transferred to the intermediate transfer belt 201. Additionally, an electrically conductive brush, a non-contact corona charger, or the like may be used instead of the transfer roller 205*d*.

The cleaning device 205*e* removes a toner remaining on the photoconductor drum 205*a*. The cleaning device 205*e* has a blade to be pressed against the photoconductor drum 205*a*. Herein, a toner recovered by the cleaning device 205*e* is recovered in the development device 205*c* by a recovering screw (not illustrated in the figure) and a toner recycle device (not illustrated in the figure) and recycled.

The charge removing lamp 205*f* radiates light so as to initialize the surface electric potential of the photoconductor drum 205*a*.

Figure 7:
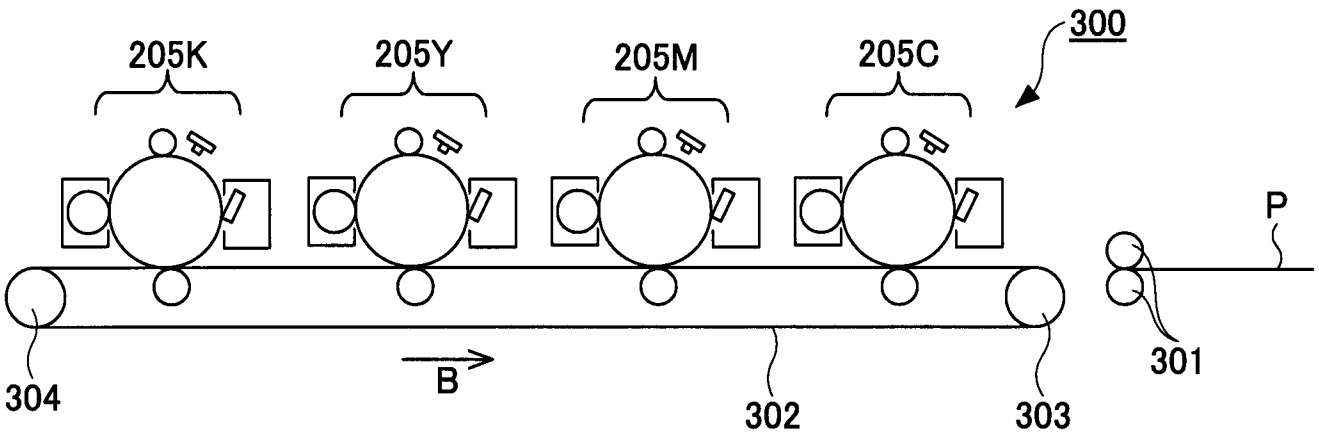
FIG. 7 is a diagram illustrating another example of an image forming apparatus according to an illustrative embodiment of the present invention.

FIG. 7 illustrates another example of an image forming apparatus according to an illustrative embodiment of the present invention. Additionally, in FIG. 7, the same reference numeral is provided to the same component as that in FIG. 5 and FIG. 6 and its descriptions are omitted. An image forming apparatus 300 directly transfers an unfixed toner image T formed on a photoconductor drum 205*a* to a recording paper sheet P. Specifically, after the recording paper sheet P is paper-fed by using a pair of paper feeding rollers 301, a conveyance belt 302 is pressed against the photoconductor drum 205*a* by using a transfer roller 205*d* whereby an unfixed toner image T is transferred to the recording paper sheet P. The recording paper sheet P to which the unfixed toner image T has been transferred is conveyed by the conveyance belt 302 to the fixation device 100 or 100' and the unfixed toner image T is fixed by the fixation device 100 or 100'. Additionally, the conveyance belt 302 extends on supporting rollers 303 and 304 and moves in the direction of an arrow B.

Practical Examples

Sample 1-1

A sample was prepared which contained 15% by mass of propylene carbonate (produced by KANTO KAGAKU) as a softening agent and 85% by mass of ion-exchanged water.

Sample 1-2

A sample was prepared which contained 15% by mass of propylene carbonate (produced by KANTO KAGAKU), 0.01% by mass of acetic acid (produced by Wako Pure Chemical Industries, Ltd.) as a pH adjustor, and 84.99% by mass of ion-exchanged water.

Sample 1-3

A sample was prepared which contained 15% by mass of propylene carbonate (produced by KANTO KAGAKU), 0.01% by mass of acetic acid (produced by Wako Pure Chemical Industries, Ltd.), 74.99% by mass of ion-exchanged water, and 10% by mass of propylene glycol (produced by KANTO KAGAKU) as a hydrolysis product of propylene carbonate.

Sample 1-4

50 ml of a sample was prepared which contained 15% by mass of propylene carbonate (produced by KANTO KAGAKU), 0.005% by mass of acetic acid (produced by Wako Pure Chemical Industries, Ltd.), and 84.995% by mass of ion-exchanged water, and subsequently its bubbling was conducted with carbon dioxide as a hydrolysis product of propylene carbonate at 50 mL/minute for one minute.

Sample 1-5

50 ml of a sample was prepared which contained 15% by mass of propylene carbonate (produced by KANTO KAGAKU), 0.005% by mass of acetic acid (produced by Wako Pure Chemical Industries, Ltd.), 74.995% by mass of ion-exchanged water, and 10% by mass of propylene glycol (produced by KANTO KAGAKU), and subsequently its bubbling was conducted with carbon dioxide at 50 mL/minute for one minute.

Sample 1-6

A sample was prepared which contained 15% by mass of propylene carbonate (produced by KANTO KAGAKU), 1% by mass of diethanolamine (produced by KANTO KAGAKU) as a pH adjustor, and 84% by mass of ion-exchanged water.

Sample 1-7

A sample was prepared which contained 15% by mass of propylene carbonate (produced by KANTO KAGAKU), 0.5% by mass of diethanolamine (produced by KANTO KAGAKU), and 84.5% by mass of ion-exchanged water.

Sample 1-8

A sample was prepared which contained 15% by mass of propylene carbonate (produced by KANTO KAGAKU), 0.05% by mass of acetic acid (produced by KANTO KAGAKU), and 84.95% by mass of ion-exchanged water.

Sample 2-1

A sample was prepared which contained 15% by mass of bis(2-methoxyethyl) adipate (produced by Tokyo Chemical Industry Co., Ltd.) as a softening agent and 85% by mass of ion-exchanged water.

Sample 2-2

A sample was prepared which contained 15% by mass of bis(2-methoxyethyl) adipate (produced by Tokyo Chemical Industry Co., Ltd.), 0.01% by mass of acetic acid (produced by Wako Pure Chemical Industries, Ltd.) and 84.99% by mass of ion-exchanged water.

Sample 2-3

A sample was prepared which contained 15% by mass of bis(2-methoxyethyl) adipate (produced by Tokyo Chemical Industry Co., Ltd.), 0.01% by mass of acetic acid (produced by Wako Pure Chemical Industries, Ltd.), 74.99% by mass of ion-exchanged water, and 10% by mass of 2-methoxyethanol (produced by KANTO KAGAKU) as a hydrolysis product of bis(2-methoxyethyl) adipate.

Sample 2-4

A sample was prepared which contained 15% by mass of bis(2-methoxyethyl) adipate (produced by Tokyo Chemical Industry Co., Ltd.), 0.005% by mass of acetic acid (produced by Wako Pure Chemical Industries, Ltd.), 84.99% by mass of ion-exchanged water, and 0.005% by mass of adipic acid (produced by KANTO KAGAKU) as a hydrolysis product of bis(2-methoxyethyl) adipate.

Sample 2-5

A sample was prepared which contained 15% by mass of bis(2-methoxyethyl) adipate (produced by Tokyo Chemical Industry Co., Ltd.), 0.005% by mass of acetic acid (produced by Wako Pure Chemical Industries, Ltd.), 74.99% by mass of ion-exchanged water, 0.005% by mass of adipic acid (produced by KANTO KAGAKU), and 10% by mass of 2-methoxyethanol (produced by KANTO KAGAKU).

Sample 2-6

A sample was prepared which contained 15% by mass of bis(2-methoxyethyl) adipate (produced by Tokyo Chemical Industry Co., Ltd.), 1% by mass of diethanolamine (produced by KANTO KAGAKU), and 84% by mass of ion-exchanged water.

Sample 2-7

A sample was prepared which contained 15% by mass of bis(2-methoxyethyl) adipate (produced by Tokyo Chemical Industry Co., Ltd.), 0.5% by mass of diethanolamine (produced by KANTO KAGAKU), and 84.5% by mass of ion-exchanged water.

Sample 2-8

A sample was prepared which contained 15% by mass of bis(2-methoxyethyl) adipate (produced by Tokyo Chemical Industry Co., Ltd.), 0.05% by mass of acetic acid (produced by Wako Pure Chemical Industries, Ltd.), and 84.95% by mass of ion-exchanged water.

Sample 3-1

A sample was prepared which contained 15% by mass of dicarbitol succinate (produced by KOKYU ALCOHOL KOGYO Co., Ltd.) as a softening agent and 85% by mass of ion-exchanged water.

Sample 3-2

A sample was prepared which contained 15% by mass of dicarbitol succinate (produced by KOKYU ALCOHOL KOGYO Co., Ltd.), 0.1% by mass of trisodium citrate (produced by Wako Pure Chemical Industries, Ltd.) as a pH adjustor, and 84.9% by mass of ion-exchanged water.

Sample 3-3

A sample was prepared which contained 15% by mass of dicarbitol succinate (produced by KOKYU ALCOHOL KOGYO Co., Ltd.), 0.05% by mass of trisodium citrate (produced by Wako Pure Chemical Industries, Ltd.), and 84.95% by mass of ion-exchanged water.

Sample 3-4

A sample was prepared which contained 15% by mass of dicarbitol succinate (produced by KOKYU ALCOHOL KOGYO Co., Ltd.), 0.05% by mass of trisodium citrate (produced by Wako Pure Chemical Industries, Ltd.), 74.95% by mass of ion-exchanged water, and 10% by mass of carbitol (produced by KANTO KAGAKU) as a hydrolysis product of dicarbitol succinate.

Sample 3-5

A sample was prepared which contained 15% by mass of dicarbitol succinate (produced by KOKYU ALCOHOL KOGYO Co., Ltd.), 0.06% by mass of trisodium citrate (produced by Wako Pure Chemical Industries, Ltd.), 84.93% by mass of ion-exchanged water, and 0.01% by mass of succinic acid (produced by KANTO KAGAKU) as a hydrolysis product of dicarbitol succinate.

Sample 3-6

A sample was prepared which contained 15% by mass of dicarbitol succinate (produced by KOKYU ALCOHOL KOGYO Co., Ltd.), 0.06% by mass of trisodium citrate (produced by Wako Pure Chemical Industries, Ltd.), 74.93% by mass of ion-exchanged water, 0.01% by mass of succinic acid (produced by KANTO KAGAKU), and 10% by mass of carbitol (produced by KANTO KAGAKU).

Sample 3-7

A sample was prepared which contained 15% by mass of dicarbitol succinate (produced by KOKYU ALCOHOL KOGYO Co., Ltd.), 1% by mass of acetic acid (produced by Wako Pure Chemical Industries, Ltd.), and 84% by mass of ion-exchanged water.

Sample 3-8

A sample was prepared which contained 15% by mass of dicarbitol succinate (produced by KOKYU ALCOHOL KOGYO Co., Ltd.), 0.2% by mass of trisodium citrate (produced by Wako Pure Chemical Industries, Ltd.), and 84.8% by mass of ion-exchanged water.

Sample 4-1

A sample was prepared which contained 15% by mass of triethylene glycol diacetate (produced by Tokyo Chemical Industry Co., Ltd.) as a softening agent and 85% by mass of ion-exchanged water.

Sample 4-2

A sample was prepared which contained 15% by mass of triethylene glycol diacetate (produced by Tokyo Chemical Industry Co., Ltd.), 0.1% by mass of trisodium citrate (produced by Wako Pure Chemical Industries, Ltd.), and 84.9% by mass of ion-exchanged water.

Sample 4-3

A sample was prepared which contained 15% by mass of triethylene glycol diacetate (produced by Tokyo Chemical Industry Co., Ltd.), 0.05% by mass of trisodium citrate (produced by Wako Pure Chemical Industries, Ltd.), and 84.95% by mass of ion-exchanged water.

Sample 4-4

A sample was prepared which contained 15% by mass of triethylene glycol diacetate (produced by Tokyo Chemical Industry Co., Ltd.), 0.05% by mass of trisodium citrate (produced by Wako Pure Chemical Industries, Ltd.), 74.95% by mass of ion-exchanged water, and 10% by mass of triethylene glycol (produced by KANTO KAGAKU) as a hydrolysis product of triethylene glycol diacetate.

Sample 4-5

A sample was prepared which contained 15% by mass of triethylene glycol diacetate (produced by Tokyo Chemical Industry Co., Ltd.), 0.06% by mass of trisodium citrate (produced by Wako Pure Chemical Industries, Ltd.), 84.93% by mass of ion-exchanged water, and 0.01% by mass of acetic acid (produced by KANTO KAGAKU) as a hydrolysis product of triethylene glycol diacetate.

Sample 4-6

A sample was prepared which contained 15% by mass of triethylene glycol diacetate (produced by Tokyo Chemical Industry Co., Ltd.), 0.06% by mass of trisodium citrate (produced by Wako Pure Chemical Industries, Ltd.), 74.93% by mass of ion-exchanged water, 0.01% by mass of acetic acid (produced by KANTO KAGAKU), and 10% by mass of triethylene glycol (produced by KANTO KAGAKU).

Sample 4-7

A sample was prepared which contained 15% by mass of triethylene glycol diacetate (produced by Tokyo Chemical Industry Co., Ltd.), 1% by mass of lactic acid (produced by Wako Pure Chemical Industries, Ltd.), and 84% by mass of ion-exchanged water.

Sample 4-8

A sample was prepared which contained 15% by mass of triethylene glycol diacetate (produced by Tokyo Chemical Industry Co., Ltd.), 0.2% by mass of trisodium citrate (produced by Wako Pure Chemical Industries, Ltd.), and 84.8% by mass of ion-exchanged water.

[Evaluation of the Hydrolysis Property of a Softening Agent]

50 mL of a sample was put in a polypropylene container with a cap and stored at 60° C. for 1 day or 3 days as an accelerated test, and the contents of a softening agent in the sample before and after it were measured by means of gas chromatography so as to obtain the residual ratio of the softening agent. Then, HEWLETT PACKARD 5890 SERIES II was used for a gas chromatograph and HEWLETT PACKARD HP-1 (30 m×0.25 mm×0.25 μm) was used for a column, wherein the temperature of the column, the temperature of an injection, the temperature of a detector, and the amount of an injected sample were 50-250° C., 200° C., 200° C., and 1 μL, respectively. Evaluation results are presented in Table 1.

TABLE 1

| Samples | pH | Hydrolysis product of softening agent | Residual rate of softening agent [%] 1 day after | 3 days after |
|---|---|---|---|---|
| 1-1 | 7 | Absence | 88.5 | 70.1 |
| 1-2 | 6 | Absence | 95.6 | 75.8 |
| 1-3 | 6 | Presence | 97.1 | 77.9 |
| 1-4 | 6 | Presence | 96.0 | 76.2 |
| 1-5 | 6 | Presence | 97.4 | 79.3 |
| 1-6 | 9 | Absence | 18.8 | 12.3 |
| 1-7 | 8 | Absence | 25.3 | 22.8 |
| 1-8 | 5 | Absence | 70.5 | 36.2 |
| 2-1 | 7 | Absence | 90.2 | 70.4 |
| 2-2 | 6 | Absence | 96.6 | 77.6 |
| 2-3 | 6 | Presence | 97.8 | 79.8 |
| 2-4 | 6 | Presence | 96.9 | 77.3 |
| 2-5 | 6 | Presence | 98.0 | 82.1 |
| 2-6 | 9 | Absence | 21.1 | 17.6 |
| 2-7 | 8 | Absence | 35.1 | 26.3 |
| 2-8 | 5 | Absence | 73.6 | 35.8 |
| 3-1 | 5 | Absence | 80.1 | 46.3 |
| 3-2 | 7 | Absence | 88.1 | 69.2 |
| 3-3 | 6 | Absence | 88.9 | 70.0 |
| 3-4 | 6 | Presence | 93.2 | 75.3 |
| 3-5 | 6 | Presence | 95.6 | 76.8 |
| 3-6 | 6 | Presence | 97.7 | 79.2 |
| 3-7 | 4 | Absence | 19.7 | 13.6 |
| 3-8 | 8 | Absence | 70.6 | 31.2 |
| 4-1 | 5 | Absence | 75.6 | 40.5 |
| 4-2 | 7 | Absence | 85.3 | 63.2 |
| 4-3 | 6 | Absence | 88.3 | 71.4 |
| 4-4 | 6 | Presence | 94.9 | 76.4 |
| 4-5 | 6 | Presence | 93.1 | 74.7 |
| 4-6 | 6 | Presence | 96.8 | 78.3 |
| 4-7 | 4 | Absence | 19.2 | 15.4 |
| 4-8 | 8 | Absence | 64.8 | 30.7 |

From Table 1, it is found that the hydrolysis of a softening agent may be suppressed when the pH of a sample is 6-7. Furthermore, it is found that the hydrolysis of a softening agent may be further suppressed by adding a hydrolysis product of the softening agent into a sample.

Practical Example 1-1

A fixation liquid with a pH of 6 was prepared which contained 10.3% by mass of BISTA-MAP (produced by Matsumoto Yushi-Seiyaku Co., Ltd.) which was myristic amido propyl dimethyl amino acetate betaine as a foaming agent, 37.5% by mass of propylene carbonate (produced by KANTO KAGAKU), 0.005% by mass of lactic acid (produced by KANTO KAGAKU) as a pH adjustor, and 52.195% by mass of ion-exchanged water. Herein, myristic acid is a fatty acid whose carbon number is 14.

Practical Example 1-2

A fixation liquid with a pH of 6 was prepared which contained 10.3% by mass of BISTA-MAP (produced by Matsumoto Yushi-Seiyaku Co., Ltd.), 37.5% by mass of propylene carbonate (produced by KANTO KAGAKU), 0.005% by mass of lactic acid (produced by KANTO KAGAKU), 0.4% by mass of myristic acid (produced by KANTO KAGAKU) as an additive, and 51.795% by mass of ion-exchanged water.

Practical Example 1-3

A fixation liquid with a pH of 6 was prepared which contained 10.3% by mass of BISTA-MAP (produced by Matsumoto Yushi-Seiyaku Co., Ltd.), 37.5% by mass of propylene carbonate (produced by KANTO KAGAKU), 0.005% by mass of lactic acid (produced by KANTO KAGAKU), 0.4% by mass of myristyl alcohol (produced by KANTO KAGAKU) as an additive, and 51.795% by mass of ion-exchanged water.

Practical Example 1-4

A fixation liquid with a pH of 6 was prepared which contained 10.3% by mass of BISTA-MAP (produced by Matsumoto Yushi-Seiyaku Co., Ltd.), 37.5% by mass of propylene carbonate (produced by KANTO KAGAKU), 0.005% by mass of lactic acid (produced by KANTO KAGAKU), 0.4% by mass of myristyl alcohol (produced by KANTO KAGAKU), 10% by mass of propylene glycol (produced by KANTO KAGAKU), and 41.795% by mass of ion-exchanged water.

Practical Example 2-1

A fixation liquid with a pH of 6 was prepared which contained 11.5% by mass of Anhitol 86B (produced by Kao Corporation) which was stearyl dimethyl amino acetate betaine as a foaming agent, 30% by mass of bis(2-methoxyethyl) adipate (produced by Tokyo Chemical Industry Co., Ltd.), 0.005% by mass of lactic acid (produced by KANTO KAGAKU), and 58.495% by mass of ion-exchanged water. Herein, stearyl group is an alkyl group whose carbon number is 18.

Practical Example 2-2

A fixation liquid with a pH of 6 was prepared which contained 11.5% by mass of Anhitol 86B (produced by Kao Corporation), 30% by mass of bis(2-methoxyethyl) adipate (produced by Tokyo Chemical Industry Co., Ltd.), 0.005% by mass of lactic acid (produced by KANTO KAGAKU), 0.4% by mass of myristic acid (produced by KANTO KAGAKU), and 58.095% by mass of ion-exchanged water.

Practical Example 2-3

A fixation liquid with a pH of 6 was prepared which contained 11.5% by mass of Anhitol 86B (produced by Kao Corporation), 30% by mass of bis(2-methoxyethyl) adipate (produced by Tokyo Chemical Industry Co., Ltd.), 0.4% by mass of myristyl alcohol (produced by KANTO KAGAKU), and 58.095% by mass of ion-exchanged water.

Practical Example 2-4

A fixation liquid with a pH of 6 was prepared which contained 11.5% by mass of Anhitol 86B (produced by Kao Corporation), 30% by mass of bis(2-methoxyethyl) adipate (produced by Tokyo Chemical Industry Co., Ltd.), 0.005% by mass of lactic acid (produced by KANTO KAGAKU), 0.4% by mass of myristyl alcohol (produced by KANTO KAGAKU), 10% by mass of 2-methoxyethonol (produced by KANTO KAGAKU), and 48.095% by mass of ion-exchanged water.

Practical Example 3-1

A fixation liquid with a pH of 6 was prepared which contained 3% by mass of Aminosurfact AMMS-P1 (produced by Asahi Kasei Chemicals Corporation) which was sodium myristoylglutamate as a foaming agent, 30% by mass of dicarbitol succinate (produced by KOKYU ALCOHOL KOGYO Co., Ltd.), 0.05% by mass of trisodium citrate (produced by Wako Pure Chemical Industries, Ltd.), and 66.95% by mass of ion-exchanged water. Herein, myristoyl group is an acyl group whose carbon number is 14.

Practical Example 3-2

A fixation liquid with a pH of 6 was prepared which contained 3% by mass of Aminosurfact AMMS-P1 (produced by Asahi Kasei Chemicals Corporation), 30% by mass of dicarbitol succinate (produced by KOKYU ALCOHOL KOGYO Co., Ltd.), 0.05% by mass of trisodium citrate (produced by Wako Pure Chemical Industries, Ltd.), 0.4% by mass of myristic acid (produced by KANTO KAGAKU), and 66.55% by mass of ion-exchanged water.

Practical Example 3-3

A fixation liquid with a pH of 6 was prepared which contained 3% by mass of Aminosurfact AMMS-P1 (produced by Asahi Kasei Chemicals Corporation), 30% by mass of dicarbitol succinate (produced by KOKYU ALCOHOL KOGYO Co., Ltd.), 0.05% by mass of trisodium citrate (produced by Wako Pure Chemical Industries, Ltd.), 0.4% by mass of 0.4% by mass of myristyl alcohol (produced by KANTO KAGAKU), and 66.55% by mass of ion-exchanged water.

Practical Example 3-4

A fixation liquid with a pH of 6 was prepared which contained 3% by mass of Aminosurfact AMMS-P1 (produced by Asahi Kasei Chemicals Corporation), 30% by mass of dicarbitol succinate (produced by KOKYU ALCOHOL KOGYO Co., Ltd.), 0.05% by mass of trisodium citrate (produced by Wako Pure Chemical Industries, Ltd.), 0.4% by mass of 0.4% by mass of myristyl alcohol (produced by KANTO KAGAKU), 10% by mass of carbitol (produced by KANTO KAGAKU), and 56.55% by mass of ion-exchanged water.

Practical Example 4-1

A fixation liquid with a pH of 6 was prepared which contained 3% by mass of sarcosinate MN (produced by Nikko Chemicals Co., Ltd.) which was sodium myristoyl sarcosine as a foaming agent, 30% by mass of triethylene glycol diacetate (produced by Tokyo Chemical Industry Co., Ltd.), 0.03% by mass of trisodium citrate (produced by Wako Pure Chemical Industries, Ltd.), and 66.97% by mass of ion-exchanged water. Herein, myristoyl group is an acyl group whose carbon number is 14.

Practical Example 4-2

A fixation liquid with a pH of 6 was prepared which contained 3% by mass of sarcosinate MN (produced by Nikko Chemicals Co., Ltd.), 30% by mass of triethylene glycol diacetate (produced by Tokyo Chemical Industry Co., Ltd.), 0.03% by mass of trisodium citrate (produced by Wako Pure Chemical Industries, Ltd.), 0.4% by mass of myristic acid (produced by KANTO KAGAKU), and 66.57% by mass of ion-exchanged water.

Practical Example 4-3

A fixation liquid with a pH of 6 was prepared which contained 3% by mass of sarcosinate MN (produced by Nikko Chemicals Co., Ltd.), 30% by mass of triethylene glycol diacetate (produced by Tokyo Chemical Industry Co., Ltd.), 0.03% by mass of trisodium citrate (produced by Wako Pure Chemical Industries, Ltd.), 0.4% by mass of myristyl alcohol (produced by KANTO KAGAKU), and 66.57% by mass of ion-exchanged water.

Practical Example 4-4

A fixation liquid with a pH of 6 was prepared which contained 3% by mass of sarcosinate MN (produced by Nikko Chemicals Co., Ltd.), 30% by mass of triethylene glycol diacetate (produced by Tokyo Chemical Industry Co., Ltd.), 0.03% by mass of trisodium citrate (produced by Wako Pure Chemical Industries, Ltd.), 0.4% by mass of myristyl alcohol (produced by KANTO KAGAKU), 10% by mass of triethylene glycol (produced by KANTO KAGAKU), and 56.57% by mass of ion-exchanged water.

Practical Example 5-1

A fixation liquid with a pH of 6 was prepared which contained 7.5% by mass of Mydol-12 (produced by Kao Corporation) which was lauryl glucoside as a foaming agent, 37.5% by mass of propylene carbonate (produced by KANTO KAGAKU), 0.035% by mass of lactic acid (produced by KANTO KAGAKU), and 54.965% by mass of ion-exchanged water. Herein, lauryl group is an alkyl group whose carbon number is 12.

Practical Example 5-2

A fixation liquid with a pH of 6 was prepared which contained 7.5% by mass of Mydol-12 (produced by Kao Corporation), 37.5% by mass of propylene carbonate (produced by KANTO KAGAKU), 0.035% by mass of lactic acid (produced by KANTO KAGAKU), 0.4% by mass of myristic acid (produced by KANTO KAGAKU), and 54.565% by mass of ion-exchanged water.

Practical Example 5-3

A fixation liquid with a pH of 6 was prepared which contained 7.5% by mass of Mydol-12 (produced by Kao Corporation), 37.5% by mass of propylene carbonate (produced by KANTO KAGAKU), 0.035% by mass of lactic acid (produced by KANTO KAGAKU), 0.4% by mass of myristyl alcohol (produced by KANTO KAGAKU), and 54.565% by mass of ion-exchanged water.

Practical Example 5-4

A fixation liquid with a pH of 6 was prepared which contained 7.5% by mass of Mydol-12 (produced by Kao Corporation), 37.5% by mass of propylene carbonate (produced by KANTO KAGAKU), 0.035% by mass of lactic acid (produced by KANTO KAGAKU), 0.4% by mass of myristyl alcohol (produced by KANTO KAGAKU), 10% by mass of propylene glycol (produced by KANTO KAGAKU), and 44.565% by mass of ion-exchanged water.

Comparative Example 1

Fatty acids in which myristic acid (produced by KANTO KAGAKU), palmitic acid (produced by KANTO KAGAKU), and stearic acid (produced by KANTO KAGAKU) were mixed at a weight ratio of 4:3:1, and diethanolamine (produced by KANTO KAGAKU) as a neutralizer, were weighed such that their molar ratio was 1:0.7, then stirred by using a stirrer at 100 rpm in ion-exchanged water at 80° C. for 30 minutes, and naturally cooled to room temperature so as to obtain an aqueous solution of a mixture of fatty acid amine salts and fatty acids (molar ratio 7:3).

A fixation liquid with a pH of 6 was prepared which contained 4.0% by mass of the mixture of fatty acid amine salts and fatty acids (molar ratio 7:3) as a foaming agent, 37.5% by mass of propylene carbonate (produced by KANTO KAGAKU), 0.5% by mass of lactic acid (produced by KANTO KAGAKU), and 58% by mass of ion-exchanged water.

Comparative Example 2

A fixation liquid with a pH of 6 was prepared which contained 7.5% by mass of Mydol-10 (produced by Kao Corporation) which was decyl glucoside as a foaming agent, 37.5% by mass of propylene carbonate (produced by KANTO KAGAKU), 0.035% by mass of lactic acid (produced by KANTO KAGAKU), and 54.965% by mass of ion-exchanged water. Herein, decyl group is an alkyl group whose carbon number is 10.

Comparative Example 3

A fixation liquid with a pH of 6 was prepared which contained 7.5% by mass of arachidyl glucoside as a foaming agent, 37.5% by mass of propylene carbonate (produced by KANTO KAGAKU), 0.035% by mass of lactic acid (produced by KANTO KAGAKU), and 54.965% by mass of ion-exchanged water. Herein, the arachidyl glucoside was synthesized from D(+)-glucose (produced by KANTO KAGAKU) and arachidic acid (produced by KANTO KAGAKU) and an arachidyl group is an alkyl group whose carbon number is 20.

[Evaluation of the Foaming Property of Fixation Liquid]

The foaming properties of the fixation liquids in the practical examples and comparative examples were evaluated by using a fixation fluid foaming device 110 as illustrated in FIG. 2. Herein, while a container 111 is a bottle made of a PET resin, a pump 112 was a tube pump wherein the material of a tube was a silicone rubber and its inner diameter is 2 mm, and a flow channel for carrying a fixation liquid L was provided in a silicone rubber tube with an inner diameter of 2 mm. Furthermore, a micropore sheet 113*b* of a coarse and large bubble creating part 113 was a 400 mesh sheet made of a stainless steel whose openings had a size of about 40 μm. Moreover, while an inner cylinder 114*a* and an outer cylinder 114*b* were made of a PET, the outer diameter and length of the inner cylinder 114*a* were 8 mm and 100 mm, respectively, and the inner diameter and length of the outer cylinder 114*b* were 10 mm and 120 mm, respectively. Then, the inner cylinder 114*a* of a fine bubble creating part 114 was fixed on a shaft and rotated by a rotation driving motor (not illustrated in the figure) at 300 rpm for 10 seconds, so that the foaming properties of the fixation liquids were evaluated. The results of such evaluation are presented in Table 2.

TABLE 2

| | Additive | Hydrolysis product of softening agent | Bulk density of foamed fixation fluid [g/cm$^3$] | Bubble state |
|---|---|---|---|---|
| Practical example 1-1 | None | Absence | 0.03852 | A |
| Practical example 1-2 | Myristic acid | Absence | 0.03009 | A |
| Practical example 1-3 | Myristyl alcohol | Absence | 0.02945 | A |
| Practical example 1-4 | Myristyl alcohol | Presence | 0.0301 | A |
| Practical example 2-1 | None | Absence | 0.07004 | A |
| Practical example 2-2 | Myristic acid | Absence | 0.06826 | A |
| Practical example 2-3 | Myristyl alcohol | Absence | 0.04471 | A |
| Practical example 2-4 | Myristyl alcohol | Presence | 0.04693 | A |
| Practical example 3-1 | None | Absence | 0.03561 | A |
| Practical example 3-2 | Myristic acid | Absence | 0.03174 | A |
| Practical example 3-3 | Myristyl alcohol | Absence | 0.02951 | A |
| Practical example 3-4 | Myristyl alcohol | Presence | 0.03187 | A |
| Practical example 4-1 | None | Absence | 0.03671 | A |
| Practical example 4-2 | Myristic acid | Absence | 0.03014 | A |
| Practical example 4-3 | Myristyl alcohol | Absence | 0.02856 | A |
| Practical example 4-4 | Myristyl alcohol | Presence | 0.02915 | A |
| Practical example 5-1 | None | Absence | 0.01678 | B |
| Practical example 5-2 | Myristic acid | Absence | 0.01426 | B |
| Practical example 5-3 | Myristyl alcohol | Absence | 0.0346 | A |
| Practical example 5-4 | Myristyl alcohol | Presence | 0.03383 | A |
| Comparative example 1 | — | — | — | C |
| Comparative example 2 | — | — | — | C |
| Comparative example 3 | — | — | — | C |

From Table 2, it is found that the fixation liquids in the practical examples were excellent in their foaming properties and could form fine bubbles even though their pHs were 6. Furthermore, it is found that the foam stability of fine bubbles was improved by adding myristic acid or myristyl alcohol to the fixation liquids in the practical examples so that the bulk densities of the foamed fixation liquids were small. On the other hand, it is found that the fixation liquids in the comparative examples were very bad in their foaming properties and could not form a fine bubble.

Herein, a foaming state was evaluated visually wherein it was determined such that "A" indicated that fine bubbles with a high foam stability were formed while "B" indicated that fine bubbles which was readily foam-broken were formed and "C" indicated that no fine bubble was formed.

[Evaluation of Image Quality]

An unfixed toner image (color image) was formed on a PPC paper sheet T-6200 (produced by Ricoh Company, Ltd.) by using an electrophotographic printer Ipsio Color CX8800 (produced by Ricoh Company, Ltd.). Then, an unfixed toner image was fixed by using a fixation device 100 as illustrated in FIG. 1. Herein, a roller made of a SUS and having a diameter of 30 mm which was baking-finished with a PFA resin was used for an application roller 120 and a roller (cored bar) made of an aluminum alloy and having a diameter of 10 mm on which a polyurethane foam material, Color Foam EMO (produced by INOAC CORPORATION), was formed such that its outer diameter was 50 mm, was used for a pressurizing roller 140. Furthermore, for a blade 130, a flat and glass plate with a thickness of 1 mm was bonded to a supporting plate made of an aluminum alloy such that a glass face was faced to a side of the application roller 120 and the gap between it and the application roller 120 was 40 μm. Additionally, the conveyance velocity of a recording paper P was 150 mm/second. Then, an image quality was evaluated while the thickness of an unfixed toner image T was 30-40 μm and the thickness of a foamed fixation liquid L' on the application roller 120 was about 70 μm. The results of such evaluation are presented in Table 3.

TABLE 3

| | Additive | Hydrolysis product of softening agent | Application quantity of foamed fixation fluid [g/cm$^3$] | Image quality |
|---|---|---|---|---|
| Practical example 1-1 | None | Absence | 135 | A |
| Practical example 1-2 | Myristic acid | Absence | 127 | A |
| Practical example 1-3 | Myristyl alcohol | Absence | 119 | A |
| Practical example 1-4 | Myristyl alcohol | Presence | 127 | A |
| Practical example 2-1 | None | Absence | 263 | B |
| Practical example 2-2 | Myristic acid | Absence | 250 | B |
| Practical example 2-3 | Myristyl alcohol | Absence | 203 | A |
| Practical example 2-4 | Myristyl alcohol | Presence | 210 | A |
| Practical example 3-1 | None | Absence | 150 | A |
| Practical example 3-2 | Myristic acid | Absence | 121 | A |
| Practical example 3-3 | Myristyl alcohol | Absence | 109 | A |
| Practical example 3-4 | Myristyl alcohol | Presence | 115 | A |
| Practical example 4-1 | None | Absence | 135 | A |
| Practical example 4-2 | Myristic acid | Absence | 108 | A |
| Practical example 4-3 | Myristyl alcohol | Absence | 95 | A |
| Practical example 4-4 | Myristyl alcohol | Presence | 99 | A |
| Practical example 5-1 | None | Absence | 88 | B |
| Practical example 5-2 | Myristic acid | Absence | 104 | B |
| Practical example 5-3 | Myristyl alcohol | Absence | 139 | A |
| Practical example 5-4 | Myristyl alcohol | Presence | 143 | A |
| Comparative example 1 | — | — | — | C |
| Comparative example 2 | — | — | — | C |
| Comparative example 3 | — | — | — | C |

From Table 3, it is found that the fixation liquids in the practical examples were excellent in an image quality even though their pHs were 6. Furthermore, it is found that an image quality was improved by adding myristic acid or myristyl alcohol to the fixation fluids in the practical examples. On the other hand, it is found that the fixation liquids in the comparative examples could not form a fine bubble to conduct fixation.

Herein, the image quality was determined such that "A" indicated to be good in terms of image defects, the degree of toner fixation, color saturation, the wetness of printing paper sheets, and a transfer when printing paper sheets were stacked, while "B" indicated that there were problems in regard to image defects and the wetness of printing paper sheets and "C" indicated that it was not possible to form a fine bubble to conduct fixation.

APPENDIX

Embodiments (1) to (11) of the present invention will be described by way of example below.

Embodiment (1)

A fixation fluid which contains a softening agent(s), a foaming agent(s), water, and a pH adjustor(s) and whose pH is 6 or more and 7 or less, wherein the fixation fluid is characterized in that the softening agent(s) is/are a saturated aliphatic carboxylic acid ester(s) of a saturated aliphatic alcohol(s) and/or a carbonic acid ester(s) of a dihydric saturated aliphatic alcohol(s), the foaming agent(s) is/are a non-ionic surfactant(s) and/or an amphoteric surfactant(s), and the pH adjustor(s) is/are an acid(s) and/or a salt(s) of the acid(s).

Embodiment (2)

The fixation fluid according to embodiment (1) as described above, characterized in that the non-ionic surfactant(s) is/are an alkylglycoside(s) having an alkyl group whose carbon number is 12 or more and 18 or less.

Embodiment (3)

The fixation fluid according to embodiment (1) or (2) as described above, characterized in that the amphoteric surfactant(s) is/are one or more kinds selected from the group consisting of fatty amido propyl dimethyl aminoacetate betaines derived from fatty acids whose carbon numbers are 12 or more and 18 or less, alkyl dimethyl aminoacetate betaines having an alkyl group whose carbon number is 12 or more and 18 or less, N-acylsarcosines having an acyl group whose carbon number is 12 or more and 18 or less, salts of the N-acylsarcosines, N-fatty-acid-acylglutamic acids derived from fatty acids whose carbon numbers are 12 or more and 18 or less, and salts of the N-fatty-acid-acylglutamic acids.

Embodiment (4)

The fixation fluid according to any one of embodiments (1) to (3) as described above, characterized by further containing a saturated aliphatic monocarboxylic acid(s) whose carbon number(s) is/are 12 or more and 18 or less and/or a saturated aliphatic monoalcohol(s) whose carbon number(s) is/are 12 or more and 18 or less.

Embodiment (5)

The fixation fluid according to any one of embodiments (1) to (4) as described above, characterized by further containing a hydrolysis product(s) of the softening agent(s).

Embodiment (6)

A fixation method characterized by including a step of foaming the fixation fluid according to any one of embodiments (1) to (5) as described above and a step of providing the foamed fixation fluid to a particle(s) containing a resin(s) so as to fix it/them on a medium.

Embodiment (7)

An image forming method characterized by including the particle(s) being a toner(s), a step of forming an electrostatic latent image on an electrostatic latent image carrier, a step of developing an electrostatic latent image formed on the electrostatic latent image carrier by using a developer containing the toner(s) so as to form a toner image, a step of transferring a toner image formed on the electrostatic latent image carrier to a medium, and a step of fixing a toner image transferred to the medium by using the fixation method according to embodiment (6) as described above.

Embodiment (8)

An image forming method characterized by including the particle(s) being a toner(s), a step of forming an electrostatic latent image on an electrostatic latent image carrier, a step of developing an electrostatic latent image formed on the electrostatic latent image carrier by using a developer containing the toner(s) so as to form a toner image, a step of transferring a toner image formed on the electrostatic latent image carrier to an intermediate transfer body, a step of transferring a toner image transferred to the intermediate transfer body to a medium, and a step of fixing a toner image transferred to the medium by using the fixation method according to embodiment (6) as described above.

Embodiment (9)

A fixation device characterized by including means of foaming the fixation fluid according to any one of embodiments (1) to (5) as described above and means of providing the foamed fixation fluid to a particle(s) containing a resin(s) so as to fix it/them on a medium.

Embodiment (10)

An image forming apparatus characterized by including the particle(s) being a toner(s), means of forming an electrostatic latent image on an electrostatic latent image carrier, means of developing an electrostatic latent image formed on the electrostatic latent image carrier by using a developer containing the toner(s) so as to form a toner image, means of transferring a toner image formed on the electrostatic latent image carrier to a medium, and means of fixing a toner image transferred to the medium by using the fixation device according to embodiment (9) as described above.

Embodiment (11)

An image forming apparatus characterized by including the particle(s) being a toner(s), means of forming an electrostatic latent image on an electrostatic latent image carrier, means of developing an electrostatic latent image formed on the electrostatic latent image carrier by using a developer containing the toner(s) so as to form a toner image, means of transferring a toner image formed on the electrostatic latent image carrier to an intermediate transfer body, means of transferring a toner image transferred to the intermediate transfer body to a medium, and means of fixing a toner image transferred to the medium by using the fixation device according to embodiment (9) as described above.

Although the illustrative embodiment(s) and specific example(s) of the present invention have been specifically described above, the present invention is not limited to the illustrative embodiment(s) or specific example(s) and the illustrative embodiment(s) and specific example(s) of the present invention can be altered, modified, and/or combined without departing from the spirit and/or scope of the present invention.

The present application claims the benefit of priority based on Japanese Patent Application No. 2008-294824 filed on Nov. 18, 2008 and Japanese Patent Application No. 2009-099250 filed on Apr. 15, 2009, the entire contents of which priority applications are hereby incorporated by reference herein.

The invention claimed is:

1. A fixation fluid, comprising:

a softening agent(s), the softening agent(s) being a saturated aliphatic carboxylic acid ester(s) of a saturated aliphatic alcohol(s) and/or a carbonic acid ester(s) of a dihydric saturated aliphatic alcohol(s);

a foaming agent(s), the foaming agent(s) being a non-ionic surfactant(s) and/or an amphoteric surfactant(s);

water;

a pH adjustor(s), the pH adjustor(s) being an acid(s) and/or a salt(s) of the acid(s); and a pH of the fixation fluid being 6 or more and 7 or less.

2. The fixation fluid as claimed in claim 1, wherein the non-ionic surfactant(s) is/are an alkylglycoside(s) comprising an alkyl group with a carbon number of 12 or more and 18 or less.

3. The fixation fluid as claimed in claim 1, wherein the amphoteric surfactant(s) is/are one or more kinds selected from the group consisting of fatty amido propyl dimethyl aminoacetate betaines derived from fatty acids with carbon numbers of 12 or more and 18 or less, alkyl dimethyl aminoacetate betaines comprising an alkyl group with a carbon number of 12 or more and 18 or less, N-acylsarcosines comprising an acyl group with a carbon number of 12 or more and 18 or less, salts of the N-acylsarcosines, N-fatty-acid-acylglutamic acids derived from fatty acids with carbon numbers of 12 or more and 18 or less, and salts of the N-fatty-acid-acylglutamic acids.

4. The fixation fluid as claimed in claim 1, further comprising a saturated aliphatic monocarboxylic acid(s) with a carbon number(s) of 12 or more and 18 or less and/or a saturated aliphatic monoalcohol(s) with a carbon number(s) of 12 or more and 18 or less.

5. The fixation fluid as claimed in claim 1, further comprising a hydrolysis product(s) of the softening agent(s).

6. A fixation method, comprising:

a step of foaming the fixation fluid as claimed in claim 1; and a step of providing the foamed fixation fluid to a particle(s) comprising a resin(s) to fix the particle(s) on a medium.

7. An image forming method, comprising:

the particle(s) being a toner(s);

a step of forming an electrostatic latent image on an electrostatic latent image carrier;

a step of developing an electrostatic latent image formed on the electrostatic latent image carrier by using a developer comprising the toner(s) to form a toner image;

a step of transferring a toner image formed on the electrostatic latent image carrier to a medium; and a step of fixing a toner image transferred to the medium by using the fixation method as claimed in claim 6.

8. An image forming method, comprising:

the particle(s) being a toner(s);

a step of forming an electrostatic latent image on an electrostatic latent image carrier;

a step of developing an electrostatic latent image formed on the electrostatic latent image carrier by using a developer comprising the toner(s) to form a toner image;

a step of transferring a toner image formed on the electrostatic latent image carrier to an intermediate transfer body;

a step of transferring a toner image transferred to the intermediate transfer body to a medium; and a step of fixing a toner image transferred to the medium by using the fixation method as claimed in claim 6.

9. A fixation device, comprising:

a part configured to foam the fixation fluid as claimed in claim 1; and a part configured to provide the foamed fixation fluid to a particle(s) comprising a resin(s) to fix the particle(s) on a medium.

10. An image forming apparatus, comprising:

the particle(s) being a toner(s);

a part configured to form an electrostatic latent image on an electrostatic latent image carrier;

a part configured to develop an electrostatic latent image formed on the electrostatic latent image carrier by using a developer comprising the toner(s) to form a toner image;

a part configured to transfer a toner image formed on the electrostatic latent image carrier to a medium; and a part configured to fix a toner image transferred to the medium by using the fixation device as claimed in claim 9.

11. An image forming apparatus, comprising:

the particle(s) being a toner(s);

a part configured to form an electrostatic latent image on an electrostatic latent image carrier;

a part configured to develop an electrostatic latent image formed on the electrostatic latent image carrier by using a developer comprising the toner(s) to form a toner image;

a part configured to transfer a toner image formed on the electrostatic latent image carrier to an intermediate transfer body;

a part configured to transfer a toner image transferred to the intermediate transfer body to a medium; and a part configured to fix a toner image transferred to the medium by using the fixation device as claimed in claim 9.

* * * * *